US007775367B2

(12) United States Patent
McDonald et al.

(10) Patent No.: US 7,775,367 B2
(45) **Date of Patent: *Aug. 17, 2010**

(54) SUSPENSION PACKAGING ASSEMBLY

(76) Inventors: John McDonald, 1088 Via Prado, Fallbrook, CA (US) 92028; Myles Comerford, 17147 Sobre los Cerros, Rancho Santa Fe, CA (US) 92091; Frank Comerford, 20 Hermitage La., Laguna Niguel, CA (US) 92677

( * ) Notice: Subject to any disclaimer, the term of this patent is extended or adjusted under 35 U.S.C. 154(b) by 0 days.

This patent is subject to a terminal disclaimer.

(21) Appl. No.: 12/508,473

(22) Filed: Jul. 23, 2009

(65) Prior Publication Data

US 2009/0272667 A1 Nov. 5, 2009

Related U.S. Application Data

(60) Continuation of application No. 10/726,256, filed on Dec. 2, 2003, now Pat. No. 7,743,924, which is a division of application No. 09/690,790, filed on Oct. 17, 2000, now Pat. No. 6,675,973.

(60) Provisional application No. 60/227,724, filed on Jul. 31, 2000.

(51) Int. Cl.
*B65D 81/02* (2006.01)

(52) U.S. Cl. ..... 206/583

(58) Field of Classification Search ..... 206/521, 206/583, 591, 594

See application file for complete search history.

(56) References Cited

U.S. PATENT DOCUMENTS

| | | | |
|---|---|---|---|
| 1,821,692 | A | 9/1931 | Copeland |
| 2,161,128 | A | 6/1939 | Boyle |
| 2,948,455 | A | 8/1960 | Frankenstein |
| 2,956,672 | A | 10/1960 | Kirkpatrick |
| 3,047,137 | A | 7/1962 | Kindseth |
| 3,326,410 | A | 6/1967 | Asenbauer |
| 3,345,643 | A | 10/1967 | Bradley |
| 3,853,220 | A | 12/1974 | Luray |
| 3,905,474 | A | 9/1975 | Haibara |
| 3,917,108 | A | 11/1975 | Thurman |

(Continued)

FOREIGN PATENT DOCUMENTS

DE 299 21 203 U1 2/2000

(Continued)

OTHER PUBLICATIONS

Co-pending U.S. Appl. No. 10/726,256, filed Dec. 2, 2003 Title: Suspension Packaging Assembly.

(Continued)

*Primary Examiner*—Jacob K Ackun, Jr.
(74) *Attorney, Agent, or Firm*—Knobbe Martens Olson & Bear LLP

(57) ABSTRACT

A packaging assembly includes a frame member and a retention member which is not permanently affixed to the frame member. The frame member can include a variety of features which allow the retention member to be tightened around an article to be packaged and thus protected from shocks and impacts during transport, display, and/or retail use. The retention member can be formed as a sleeve or with pockets for engaging the frame member.

11 Claims, 29 Drawing Sheets

U.S. PATENT DOCUMENTS 4,077,518 A 3/1978 Kisslinger et al.
4,155,453 A 5/1979 Ono
4,606,460 A 8/1986 Luray
4,852,743 A 8/1989 Ridgeway
4,923,065 A 5/1990 Ridgeway
5,046,659 A 9/1991 Warburton
5,056,665 A 10/1991 Asenbauer
5,071,009 A 12/1991 Ridgeway
5,076,436 A 12/1991 Bortolani et al.
5,080,497 A 1/1992 Peppiatt
5,183,159 A 2/1993 Hojnacki et al.
5,211,290 A 5/1993 Janus et al.
5,218,510 A 6/1993 Bradford
5,223,121 A 6/1993 Dickie et al.
5,226,542 A 7/1993 Boecker et al.
5,251,760 A 10/1993 Smith et al.
5,323,896 A 6/1994 Jones
5,372,257 A 12/1994 Beauchamp et al.
5,388,701 A 2/1995 Ridgeway
5,394,985 A 3/1995 Van Hest
5,405,000 A 4/1995 Hagedon et al.
5,492,223 A 2/1996 Boardman et al.
5,579,917 A 12/1996 Lofgren et al.
5,641,068 A 6/1997 Warner
5,669,506 A 9/1997 Lofgren et al.
5,676,245 A 10/1997 Jones
5,678,695 A * 10/1997 Ridgeway et al. ..... 206/583
5,694,744 A 12/1997 Jones
5,722,541 A 3/1998 Lofgren et al.
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,954,203 A 9/1999 Marconi
5,967,327 A 10/1999 Jones
RE36,412 E 11/1999 Jones
5,975,307 A 11/1999 Harding et al.
5,988,387 A 11/1999 Staal et al.
6,006,917 A 12/1999 Loeffler
6,010,003 A 1/2000 Wilkinson
6,073,761 A 6/2000 Jones
6,079,563 A 6/2000 Katchmazenski
6,119,863 A 9/2000 Lofgren et al.
6,148,591 A * 11/2000 Ridgeway et al. ..... 53/499
6,158,589 A 12/2000 Smith et al.
6,206,194 B1 3/2001 Beneroff et al.
6,223,901 B1 5/2001 Lofgren et al.
6,289,655 B1 9/2001 Ridgeway et al.
6,311,843 B1 11/2001 Smith et al.
6,398,412 B2 6/2002 Wedi et al.
6,467,624 B1 10/2002 Lofgren et al.
6,675,973 B1 1/2004 McDonald et al.
6,899,229 B2 5/2005 Dennison et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,150,356 B2 12/2006 Lofgren et al.
7,290,662 B2 11/2007 Lofgren et al.
7,296,681 B2 11/2007 McDonald et al.
2001/0047950 A1 12/2001 Beneroff et al.
2003/0234207 A1 12/2003 Koike
2004/0108239 A1 6/2004 McDonald et al.
2004/0178113 A1 9/2004 Lofgren et al.
2005/0011807 A1 1/2005 Dennison et al.
2006/0000743 A1 1/2006 Lofgren et al.
2006/0042995 A1 3/2006 McGrath et al.
2006/0102515 A1 5/2006 McDonald et al.
2006/0138018 A1 6/2006 McDonald et al.
2006/0213803 A1 9/2006 Saitou et al.
2007/0080095 A1 4/2007 McDonald et al.
2007/0251854 A1 11/2007 McDonald et al.
2008/0067103 A1 3/2008 McDonald et al.
2008/0099368 A1 5/2008 McDonald et al.
2008/0110788 A1 5/2008 Keiger
2008/0110794 A1 5/2008 Anderson et al.
2008/0128316 A1 6/2008 McDonald et al.
2008/0223750 A1 9/2008 McDonald et al.

FOREIGN PATENT DOCUMENTS

DE 101 05 487 A1 8/2002
EP 1 561 693 A1 8/2005
RU 827346 5/1981
WO 00/53499 A2 9/2000

OTHER PUBLICATIONS

Co-pending U.S. Appl. No. 11/606,470, filed Nov. 30, 2006 Title: Suspension Packaging Assembly.
Co-pending U.S. Appl. No. 11/965,591, filed Dec. 27, 2007 Title: Suspension Packaging System.
Co-pending U.S. Appl. No. 11/943,514, filed Nov. 20, 2007 Title: Suspension Packaging System.
Co-pending U.S. Appl. No. 11/633,712, filed Dec. 5, 2006 Title: Suspension Packaging Assembly.
Co-pending U.S. Appl. No. 11/412,693, filed Apr. 27, 2006 Title: Suspension Packaging Assembly.
Co-pending U.S. Appl. No. 11/687,443, filed Mar. 16, 2007 Title: Suspension Package Assembly.
Co-pending U.S. Appl. No. 12/497,474, filed Jul. 2, 2009 Title: Suspension Packaging System.

* cited by examiner

SUSPENSION PACKAGING ASSEMBLY

PRIORITY INFORMATION

This application is a Continuation Application of U.S. patent application Ser. No. 10/726,256, filed Dec. 2, 2003, which is a Divisional Application of U.S. patent application Ser. No. 09/690,790, filed Oct. 17, 2000, now U.S. Pat. No. 6,675,973 based on and claims priority to U.S. Provisional Patent Application No. 60/227,724, titled SUSPENSION PACKAGING ASSEMBLY, filed Jul. 31, 2000, the entire contents of which is hereby expressly incorporated by reference.

BACKGROUND OF THE INVENTION

1. Field of the Invention

The present invention is directed to a packaging assembly. In particular, the present invention is directed to a suspension packaging assembly that includes a retention member and a frame member.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact to the box that can occur during loading, transit and unloading. In addition, when shipping articles such as computer components, it is often desirable to protect those components from dust and dirt.

In most cases, some additional structure is used to keep the article from moving uncontrollably in the box and thus incurring damage. Such additional structures include paper or plastic packing material, structured plastic foams, and foam-filled cushions, and the like. Ideally, the article to be packaged is suspended within the box so as to be spaced from the walls defining the box, thus protecting the article from other foreign objects which may impact or compromise the outer walls of the box.

A need therefore exists for a simple, inexpensive yet reliable packaging assembly for suspending an article to be packaged within the interior of a shipping container.

SUMMARY OF THE INVENTION

One aspect of the present invention includes the recognition that the cost of certain processes used for manufacturing known suspension packaging devices can be sufficiently high to prohibit the use of suspension packaging with many common goods. For example, it has been known to permanently bond resilient sheet material to cardboard frames in order to produce suspension packaging devices in a variety of configurations for suspending articles within boxes. However, it is difficult and expensive to automate an assembly line for bonding such films to cardboard substrates or to perform such an assembly process manually. Additionally, certain known suspension packaging devices can be complex and require excessive training in order to properly assemble the devices. Thus, it is desirable to provide a packaging assembly which is inexpensive to manufacture and easy to assemble.

Another aspect of the present invention includes the recognition that certain known suspension packaging devices are not recyclable or reusable. For example, the suspension packaging devices noted above, which incorporate a resilient polymer film member permanently bonded to a rigid cardboard substrate, are not easily reusable or recyclable. In order to recycle such a packaging device, the film must be removed from the rigid cardboard backing so that the respective materials forming the film and the backing can be appropriately separated and shipped to an appropriate recycling facility. The process of separating the film from the rigid substrate permanently damages the backing member and/or the film since the film is permanently bonded to the backing. Thus, not only is it difficult to recycle the materials used for constructing the packaging device, it is difficult to reuse either the film or the backing individually since these materials are damaged upon the removal of the film from the backing. It is therefore desirable to provide a suspension packaging assembly which includes a retention member and a frame member that are not permanently affixed to each other.

In one mode, a frame member for a packaging assembly includes a plurality of fold lines configured to form at least one foldable portion. The foldable portion is foldable between at least a first position and a second deployed position in which the foldable portion forms a releasably engageable peripherally extending structure. By providing the frame member with a foldable portion as such, the frame member can be placed within a sleeve and folded to the second position, thus expanding the foldable portion and tightening the sleeve. As such, the frame member provides enhanced flexibility in the manner in which it can be used as a suspension packaging device.

In another mode, a packaging assembly includes a first frame member having a plurality of fold lines and a retention sleeve configured to receive the frame member. The plurality of fold lines are configured to form at least one foldable portion which is foldable between at least a first position and a second deployed position in which the foldable portion forms a peripherally extending structure within the sleeve when the frame member is received within the sleeve. By providing the frame member with a foldable portion as such, the present invention provides a suspension packaging assembly that achieves several advantages over known suspension packaging devices.

For example, since the packaging device, according to the present invention, includes a retention sleeve and a frame member having a foldable portion configured to form a peripherally extending structure within the sleeve, it is not necessary to bond the sleeve to the frame. Thus, the packaging device does not require the expensive and time consuming steps associated with permanently bonding the retention member to the frame member. Additionally, since the retention member is not required to be permanently bonded to the frame member, the manufacturing of these individual components can be performed at facilities that are located geographically distant from each other. For example, where a polymer film is used as the retention sleeve, the polymer film can be manufactured in a distant country and shipped to an assembly or a distribution facility without incurring prohibitive shipping costs since polymer film materials typically do not have great bulk and are relatively lightweight. However, the frame members are typically formed of corrugated cardboard; a material which has relatively great bulk and weight. Thus, it can be prohibitively expensive to manufacture corrugated cardboard components at a great distance from the distribution facility. By incorporating a retention sleeve which is not permanently bonded to the frame member, the individual components of the packaging device according to the present invention can be manufactured at distant geographic locations. Each component can thus be manufactured with the greatest economic efficiency, i.e., the individual components can be manufactured at locations, which may be in foreign countries, that offer the least expensive combination of labor, raw materials, and transportation to the distribution facility.

According to another aspect of the present invention, a packaging assembly includes a retention member having pockets formed at opposite ends thereof and a frame member having first and second portions, at least one of which is rotatable with respect to the other. The first and second portions are also configured to fit within the pockets. With the first and second portions received within the pockets of the retention member, the retention member can be tightened by rotating the rotatable first or second portion. Thus, an article to be packaged can be placed between the retention member and the frame member and can be secured thereto by rotating the rotatable first or second portions of the frame member so as to tighten the retention member over the article to be packaged.

As noted above, it is advantageous to utilize with suspension packaging devices retention members that are not permanently bonded to the frame members. Thus, by providing the retention member with pockets, according to the present aspect of the invention, the packaging device does not require the costly and time consuming manufacturing steps required for bonding a retention member to a frame member. Rather, the pockets formed on the retention member can be formed, for example, but without limitation, by a simple heat sealing process, thus eliminating the need for adhesives, specialized machinery for dispensing adhesives, and the time consuming steps required for properly bonding the retention member to the frame member with an adhesive. Additionally, the packaging assembly can be conveniently disassembled for recycling or reuse.

Another aspect of the present invention involves the recognition that the economic impact of forming pockets by heat sealing, rather than adhesive, reduces the costs of such packaging devices to such an extent that these packaging devices can now be used with a wider variety of less expensive goods that benefit from such protective packaging.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the embodiments having reference to the attached figures, the invention not being limited to any particular embodiment(s) disclosed.

BRIEF DESCRIPTION OF THE DRAWINGS

These and other features of the invention will now be described with reference to the drawings of several embodiments of the present packaging assembly and kit which are intended to illustrate, but not to limit the invention. The drawings contain the following figures.

DETAILED DESCRIPTION OF EMBODIMENTS

An improved packaging assembly is disclosed herein. The packaging assembly includes an improved structure which provides an easy-to-assemble and less expensive alternative to known suspension packaging devices.

In the following detailed description, terms of orientation such as "upper," "lower," "longitudinal," "horizontal," "vertical," "lateral," "midpoint," and "end" are used here to simplify the description in the context of the illustrated embodiment. Because other orientations are possible, however, the present invention should not be limited to the illustrated orientation. Those skilled in the art will appreciate that other orientations of the various components described above are possible.

Figure 1:
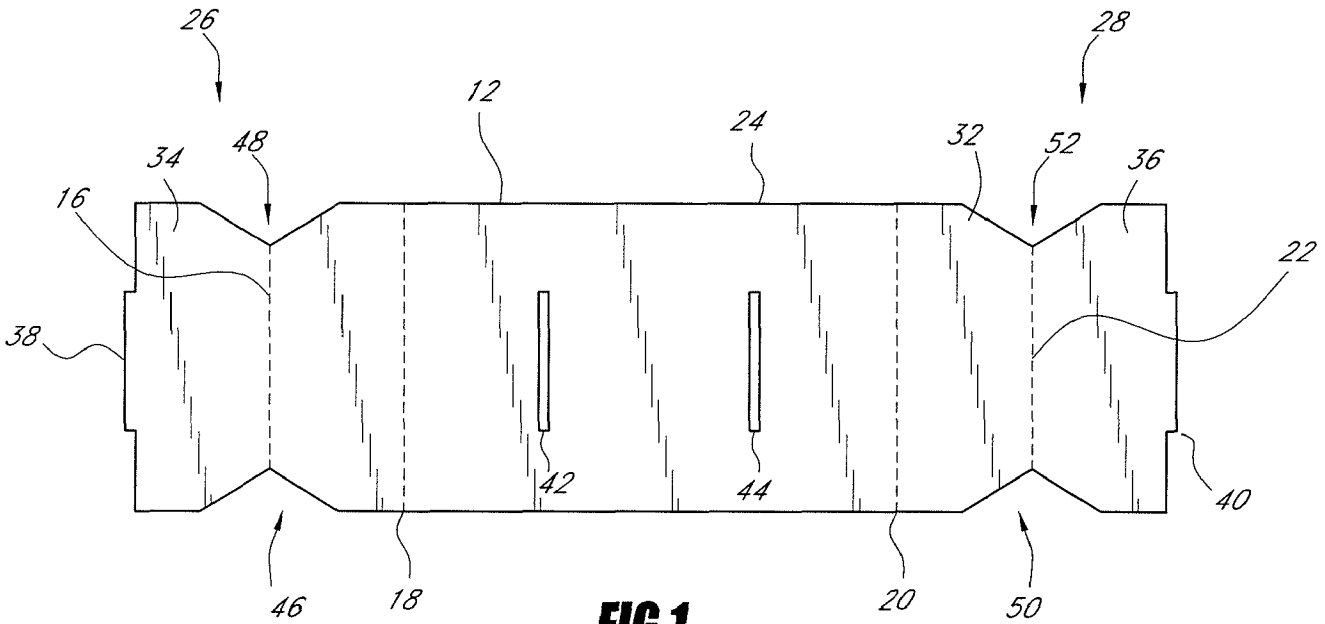
FIG. 1 is a top plan view of a frame member configured in accordance with an embodiment of the present invention, in an unfolded state.
Figure 2:
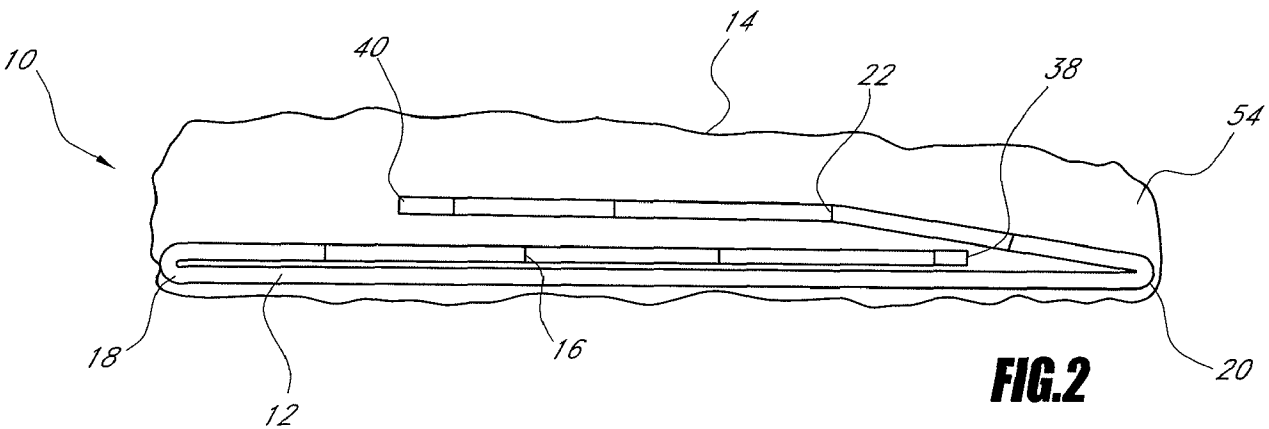
FIG. 2 is a front elevational view of the frame member shown in FIG. 1, folded and inserted within a retention sleeve, the frame member and the retention sleeve forming a packaging assembly constructed in accordance with an embodiment of the invention.
Figure 4:
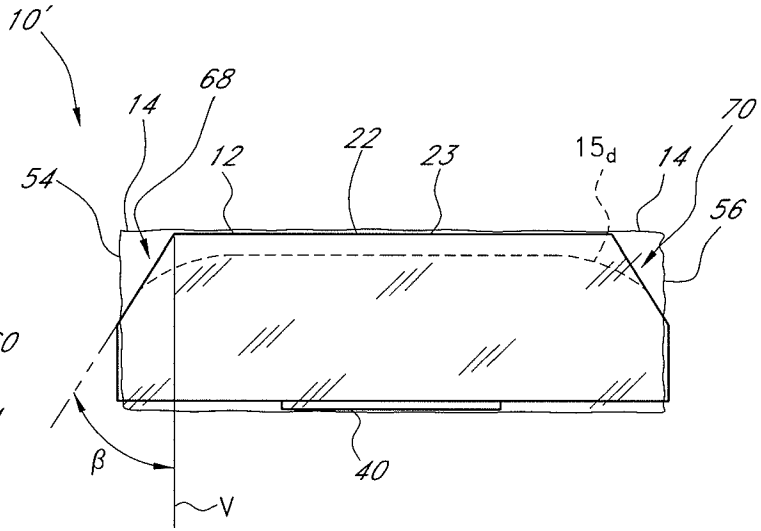
FIG. 4 is a side elevational view of the assembly shown in FIG. 3.
Figure 3:
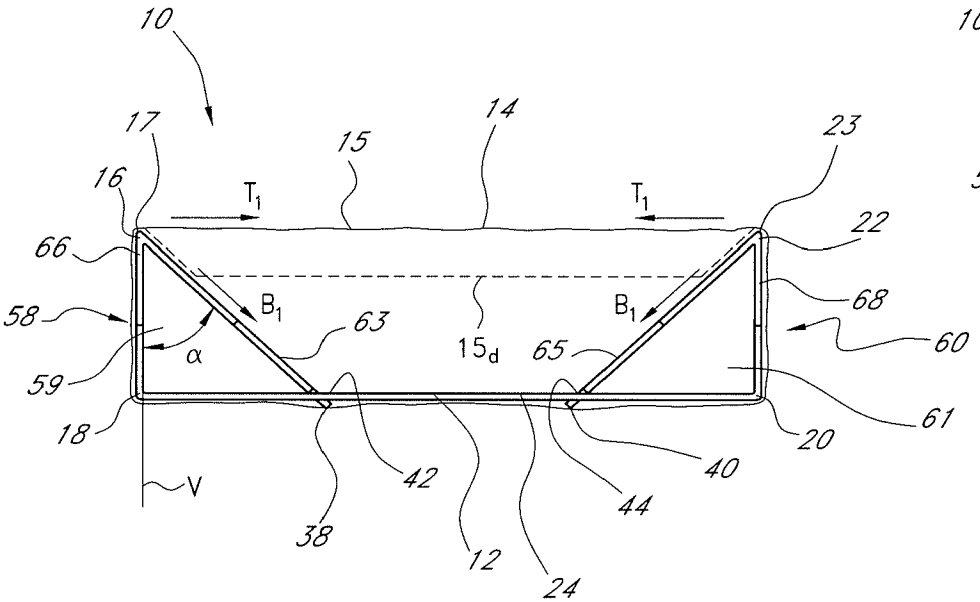
FIG. 3 is a front elevational view of the assembly shown in FIG. 2, with the frame member deployed so as to form two peripherally extending structures within the retention sleeve.

FIGS. 1-4 illustrate a packaging assembly configured in accordance with an embodiment of the present invention. With initial reference of FIGS. 1-4, a frame member 12 (FIG. 1) and a retention sleeve 14 (FIG. 2) cooperate to form a packaging assembly 10 (FIGS. 2-4).

With reference to FIG. 1, the frame member 12 can be constructed from various materials, including but without limitation, paper, cardboard, corrugated cardboard, plastic, and/or appropriate like materials. The chosen material for constructing the frame member 12 can be any substantially rigid but foldable material. It will be appreciated that, although denominated as rigid, the chosen material would preferably have a certain amount of flexibility in the cases of extreme physical impact. In the present embodiment, the preferred material is a single wall corrugated C-flute cardboard.

FIG. 1 illustrates a top plan view of the frame member 12 having a plurality of fold lines 16, 18, 20, 22. The fold lines 16, 18, 20, 22 can be formed as perforations in the frame member 12, i.e., broken cut lines passing partially or completely through the material forming the frame member 12. In the alternative or in addition, the fold lines 16, 18, 20, 22 can be crushed portions of the material forming the frame member. Of course, depending on the material used to construct the frame member 12, the fold lines 16, 18, 20, 22 can be formed as mechanical hinges, thinned portions of the member 12 or any other appropriate mechanical connection which would allow various portions of the frame member 12 to be folded or rotated with respect to each other.

With reference to FIG. 1, the frame member 12 has a generally rectangular shape. However, it will be appreciated that the shape of the frame member 12 is determined in accordance with the desired overall shape of the packaging assembly. Those skilled in the art can readily design the appropriate shape and size of the frame member 12 to suit a particular application. For example, the product to be packaged can dictate the final size and shape of the packaging assembly.

As shown in FIG. 1, the fold lines 18 and 20 serve as a boundary between a main substrate portion 24 of the frame member 12 and first and second foldable portions 26, 28 of the frame member 12. The foldable portions 26, 28 each have a fold line 16, 22, respectively, approximately bisecting the foldable portions 26, 28. Thus, within each foldable section 26, 28, the fold lines 16, 22 bisect the respective folding portions into an inner panel 30, 32 and an outer panel 34, 36.

Additionally, each foldable portion 26, 28 includes a projection 38, 40, respectively. In the illustrated embodiment, the projections 38, 40 are formed monolithically with the frame member 12, and in particular, monolithically with the outer panels 34, 36. However, it will be appreciated that the projections 38, 40 can be formed from other materials, bonded, attached or otherwise mechanically interfaced with the frame member 12.

As shown in FIG. 1, the main substrate portion 24 of the frame member 12 also includes two receptacles 42, 44 that are configured to receive the projections 38, 40 and need not pierce the substrate portion 24. In the illustrated embodiment, the apertures 42, 44 are formed as rectangular throughholes extending through the main substrate portion 24. However, it will be appreciated that the receptacles 42, 44 can be configured according to the construction of the projections 38, 40 and need not project through the substrate 24. Preferably, the projections 38, 40 and the receptacles 42, 44 configured such that the projections 38, 40 are releasably engageable with the receptacles 42, 44, as will be discussed below in detail.

Optionally, the frame member 12 can include notches 46, 48, 50, 52. In the illustrated embodiment, the notches 46, 48, 50, 52 are aligned with the fold lines 16, 22. Arranged as such, the notches 46, 48, 50, 52 allow the frame member 12 to be used in nesting engagement with another component, described in detail below with reference to FIG. 8.

With reference to FIGS. 1 and 2, the fold lines 18, 20 allow the frame member 12 to be folded between the unfolded state shown in FIG. 1 and a folded state shown in FIG. 2. The illustrated position of the foldable portions 26, 28 in FIG. 2 is an example of a folded position of the frame member 12 having a minimum overall periphery. In this folded position, the frame member 12 can be inserted into the retention sleeve 14.

With reference to FIGS. 2-4, the retention sleeve 14 preferably is constructed of a tube-shaped or endless belt-shaped film so as to form open ends 54, 56 having an overall peripheral length. In the present embodiment, the retention sleeve 14 is formed of a pliable polyethylene film. However, virtually any polymer, elastomer, or plastic film can be used to form the retention sleeve 14. The density of the film can be varied to provide the desired retention characteristics such as overall strength, resiliency, and vibration response. Preferably, the density of the retention sleeve 14 is determined such that the retention sleeve is substantially resilient when used to package a particular article.

Preferably, the overall perimeter of the retention sleeve 14 is sized such that when the foldable portions 26, 28 are deployed so as to form peripherally extending structures 58, 60 (FIG. 3), the retention sleeve 14 is tightened. For example, with reference to FIGS. 2-4, after the frame member 12, in the folded state illustrated in FIG. 2, has been inserted into the retention sleeve 14 through one of the open ends 54, 56, the foldable portions 26, 28 can be folded into a deployed position in which the projections 38, 40 are received within the receptacles 42, 44.

More particularly, in the illustrated example, once the foldable portions 26, 28 are arranged in the position shown in FIG. 2, the foldable portions 26, 28 can be further folded along the fold lines 16, 22, respectively, until the panels 32, 34 and the panels 30, 36 form the releasably engageable peripherally extending structures 58, 60, as illustrated in FIG. 3. In this position, the peripherally extending structures 58, 60 define a boundary substantially surrounding a volume of space 59, 61 within each structure 58, 60, respectively. When in the deployed position, the structures 58, 60 increase the overall peripheral dimension of the frame member 12 and occupy a greater amount of space within the sleeve 14 as compared to when the frame member 12 is in the position illustrated in FIG. 2. Thus, when the peripherally extending structures 58, 60 are deployed, the sleeve 14 is tightened.

As shown in FIG. 2, in the deployed position, the outer panels 34, 36 form inclined walls 63, 65 of the peripherally extending structures 58, 60, respectively. In the illustrated embodiment, the inclined walls 63, 65 extend from the fold lines 16, 22 at an angle $\alpha$ with relative to an axis V which extends normal to the main substrate 24. As such, the peripherally extending structures 58, 60 form free edges 17, 23 along the fold lines 16, 22, respectively. Thus, the peripherally extending structures 58, 60 increase the overall peripheral dimension of the frame member 12 and form a tightened and unsupported span 15 in the sleeve 14 between the free edges 17, 23.

Figure 8:
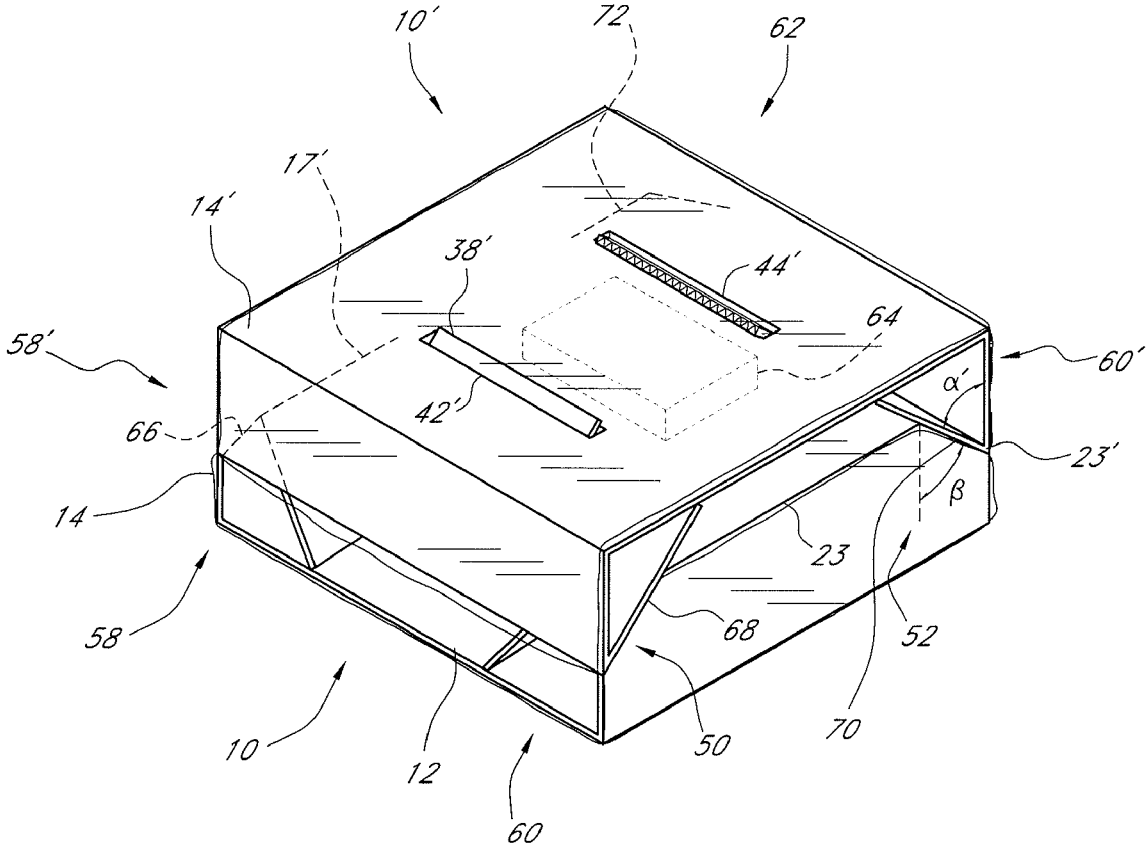
FIG. 8 is a perspective view of the assembly shown in FIGS. 3 and 4 forming a bottom portion of a packaging assembly, and the assembly shown in FIGS. 6 and 7 nested onto the top of the assembly shown in FIGS. 3 and 4 forming another modification of the assembly shown in FIG. 3, with an article to be packaged disposed between the retention members of the respective assemblies.

With reference to FIG. 4, the notches 46, 48, 50, 52 form tapered portions 66, 68, 70, 72 of the peripherally extending structures 58, 60. For example, as shown in FIG. 4, when the peripherally extending structures are deployed, the notches 50, 52 (FIG. 1) form tapered portions 68, 70, respectively. The tapered portions 68, 70 extend from the free edge 23 at an angle $\beta$ relative to the axis V. Similarly, as shown in FIG. 8, the notches 46, 48 (FIG. 1) form tapered portions 66, 72, which extend from the free edge 17 at the angle $\beta$.

In the illustrated embodiment, the peripherally extending structures 58, 60 have triangular cross-sections, thus forming triangular or prism-shaped tubes. The triangular shape of the peripherally extending structures 58, 60 results from the arrangement of two parallel fold lines 16, 18, arranged between a projection 38 and the corresponding receptacle 42. That is, since there are two fold lines 16, 18 arranged between the projection 38 and the receptacle 42, the resulting peripherally extending structure 58 is triangular or prism-shaped when the projection 38 is received and the receptacle 42. However, it is to be noted that the peripherally extending structures 58, 60 can be in the form of other shapes, including but without limitation, annular, cylindrical, square, rectangular, circular and the like. In the present embodiment, triangular structures 58, 60 are preferable due to the inherent stability of a triangular shape as well as the efficient use of space resulting from the use of triangular peripherally extending structures 58, 60.

As noted above, the overall peripheral dimension of the sleeve 14 is sized such that when the foldable portions 26, 28 are deployed into the peripherally extending structures 58, 60, the cylindrical sleeve 14 is tightened. Depending on the desired use, the retention sleeve 14 can be sized such that all slack is removed from the sleeve 14 when the foldable portions 26, 28 are deployed, thus forming an unsupported span 15 of the resilient sleeve 14. Alternatively, the retention sleeve 14 can be sized so as to remain slackened when the foldable portions 26, 28 are deployed. However, by sizing the sleeve 14 such that the sleeve 14 is tightened, or elastically deformed when the foldable portions 26, 28 are deployed, the tension generated in the sleeve 14 aids in biasing the projections 38, 40 to remain engaged with the receptacles 42, 44.

For example, the reference to FIG. 3, when there is tension in the sleeve 14, the sleeve 14 tends to constrict its overall peripheral dimension. Thus, where the sleeve 14 contacts the peripherally extending structures 58, 60, generally at the fold lines 16, 22, the tension in the sleeve 14 acts in the direction arrows $T_1$. When applied to the peripherally extending structures 58, 60, the resulting force along arrow $T_1$ causes a corresponding force in a direction of arrow $B_1$, thus biasing the projections 38, 40 into the receptacles 42, 44. As such, a packaging device shown in FIGS. 3 and 4 tends to remain in the assembled state illustrated in FIGS. 3 and 4.

By constructing the frame member 12 and the retention sleeve 14 as such, the packaging assembly 10 can be used in a variety of arrangements for packaging articles to be packaged, which will be discussed below.

Figure 5:
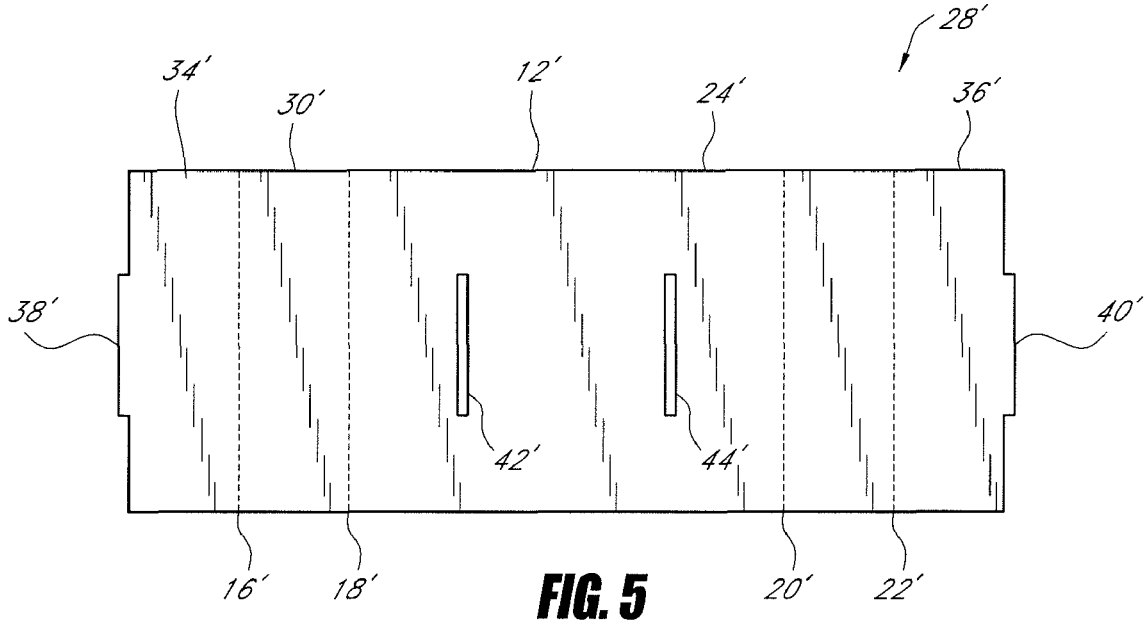
FIG. 5 is a top plan view of a frame member constructed in accordance with a modification of the embodiment shown in FIGS. 1-4, in an unfolded state.
Figure 7:
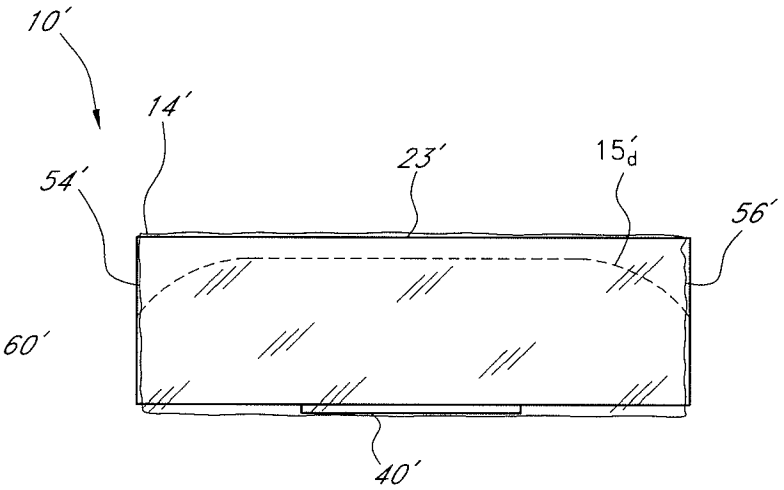
FIG. 7 is a side elevational view of the assembly shown in FIG. 6.
Figure 6:
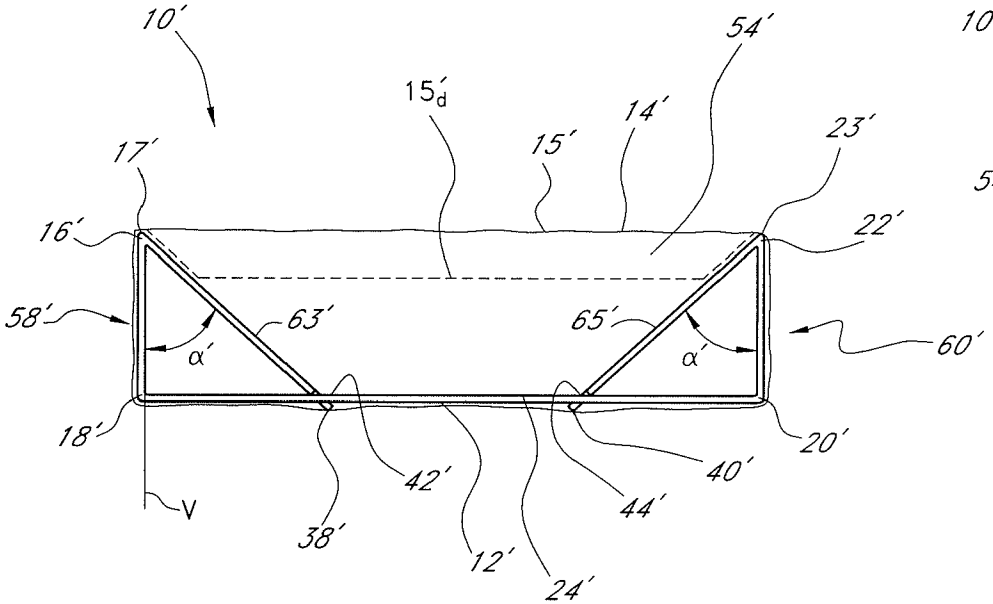
FIG. 6 is a front elevational view of the frame member shown in FIG. 5 inserted within a retention sleeve to form a modification of the assembly shown in FIG. 3, with a deflected position of the retention member shown in phantom.

With reference to FIGS. 5-7, a modification of the embodiment shown in FIGS. 1-4 will be described. As shown in FIGS. 5-7, a frame member 12' (FIG. 5) and a retention sleeve 14' (FIG. 6) form the packaging assembly 10' illustrated in FIG. 7.

The packaging assembly 10' shown in FIGS. 5-7 is constructed substantially identically to the assembly 10 shown in FIGS. 2-4, except as noted below. Thus, the assembly 10' shown in FIGS. 6-8 includes the same reference numerals as the assembly 10 shown in FIGS. 2-4, however, with a "'" added. The above description applies equally to the common elements unless otherwise indicated. Therefore, a further description of the assembly 10' is not necessary for one of ordinary skill in the art to practice the invention.

With reference to FIG. 8, a packaging assembly 62 is shown therein. The packaging assembly 62 includes the packaging assembly 10 shown in FIG. 3, and the packaging assembly 10' shown in FIG. 6 arranged in an opposed orientation and having an article to be packaged 64 (shown in phantom) disposed between the unsupported spans 15, 15'.

Preferably, when an article 64 is placed with the packaging assembly 62, one of the assemblies 10, 10', which may be referred to as subassemblies 10, 10' of the assembly 62, include tapered portions of the upper surface of the peripherally extending structures 58, 58', 60, 60'. For example, as noted above with respect to FIGS. 1, 3 and 4, the frame member 12 includes notches 46, 48, 50, 52. As shown in FIG. 4, when the foldable portions 26, 28 are deployed such that the projections 38, 40 are received within the receptacles 42, 44, respectively, the notches 46, 48, 50, 52 form tapered portions 66, 68, 70, 72 on the upper surfaces of the peripherally extending structures 58, 60. As noted above with reference to FIGS. 1, 4, and 8, the tapered portions 66, 68, 70, 72 extend from the free edges 17, 23 at the angle $\beta$ relative to the axis V. Additionally, as illustrated in FIG. 6, the inclined walls 63', 65' extend from the free edges 17', 23', respectively, at the angle $\alpha'$.

By providing at least one of the assemblies 10, 10' with tapered portions, such as tapered portions 66, 68, 70, 72, the subassemblies 10, 10' can be nested with each other when stacked in an opposed arrangement. By configuring the subassemblies 10, 10' to nest, as shown in FIG. 8, the retention sleeves 14, 14' are further tightened and preferably stretched around the article 64 due to the nesting engagement of the peripherally extending structures 58', 60' with the tapered portions 66, 72 and 68, 70, respectively.

For example, as illustrated in FIG. 6, when the subassembly 10' is nested with the subassembly 10, the unsupported span 15' is deflected inwardly, as viewed in FIGS. 6 and 7, to the position indicated as $\mathbf{15'}_d$. Similarly, the unsupported span 15 is deflected inwardly, to the position indicated as $\mathbf{15}_d$ in FIGS. 3 and 4. With the article 64 disposed between the deflected unsupported spans $\mathbf{15}_d$, $\mathbf{15'}_d$, the sleeves 14, 14' substantially envelope the article 64. Thus, the nesting engagement of the subassemblies 10, 10' provides additional tension in the retention sleeves 14, 14' which thereby aids in securing the article 64 between the unsupported spans 15, 15'. Preferably, the angle $\alpha'$ is approximately equal to the angle $\beta$. As such, the nesting engagement of the subassemblies 10, 10' is further enhanced, thus providing a tightly nested assembly 62.

With the subassemblies 10, 10' and the article to be packaged 64 arranged as shown in FIG. 8, the assembly 62 can be placed into a box and shipped through conventional delivery routes. As noted above, since the retention sleeves 14, 14' are not permanently bonded to the frame members 12, 12', the retention sleeves 14, 14' can be manufactured at a location that is geographically distant from a facility which manufactures the frame members 12, 12' and/or a facility which assembles the packaging assemblies 10, 10', 62 for use or into kits for delivery to businesses which have a need for packaging materials.

In one mode, a packaging assembly kit can include at least one frame member 12, 12' and at least one retention sleeve 14, 14'. Such a kit can be shipped to a customer who has a need for packaging assemblies. Alternatively, a kit can include at least one of the frame members 12 with notches, at least one of the frame members 12' without notches, at least one of the retention sleeves 14, and at least one of the retention sleeves 14', thus providing a kit for forming the packaging assembly 62 illustrated in FIG. 8. For customers who require large numbers of packaging assemblies, a kit can include a plurality of the frame members 12 and/or 12' stacked in the unfolded state illustrated in FIGS. 1 and 5, and a plurality of resilient sleeves 14 and/or 14' packaged in a single container. Provided as such, the present kit requires a minimum of storage space for storing the packaging assemblies formed with these materials.

Figure 9:
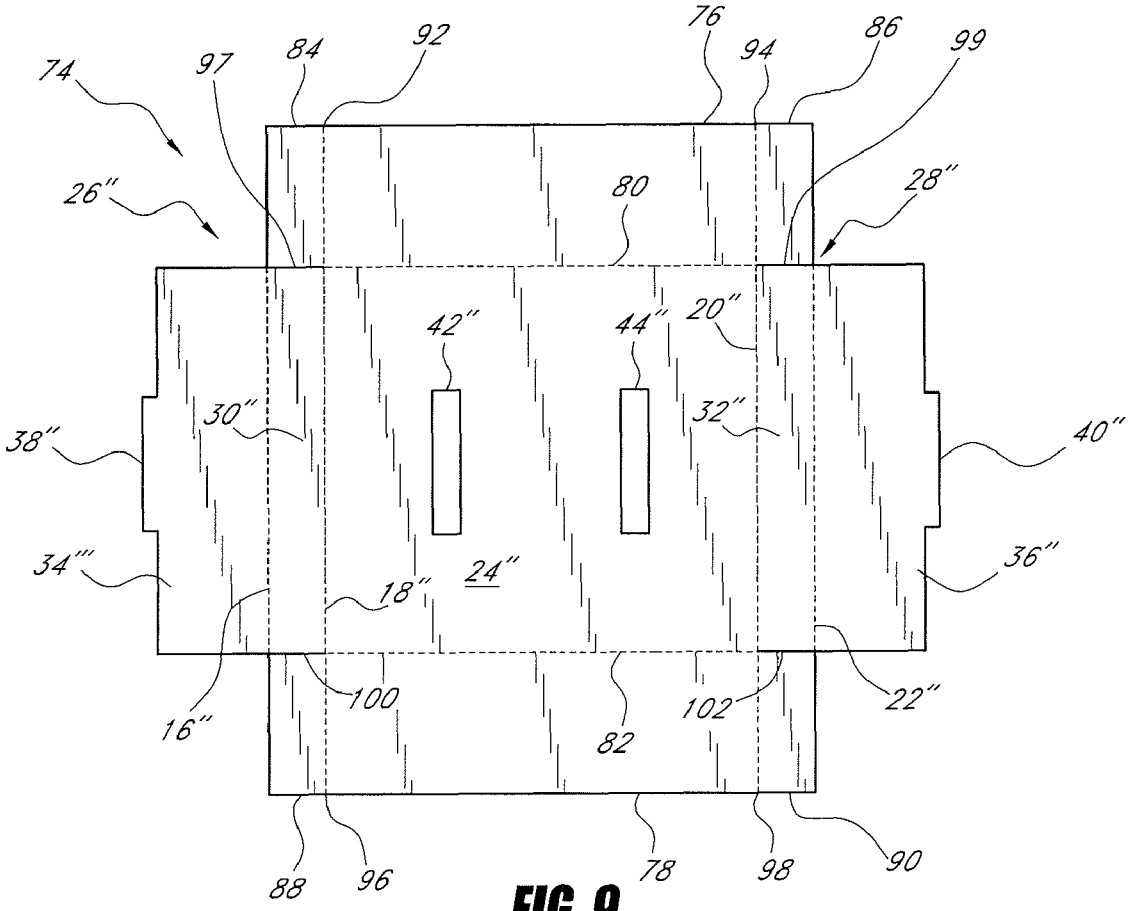
FIG. 9 is a top plan view a frame member in an unfolded state constructed in accordance with a modification of the embodiment shown in FIGS. 1-4.
Figure 10:
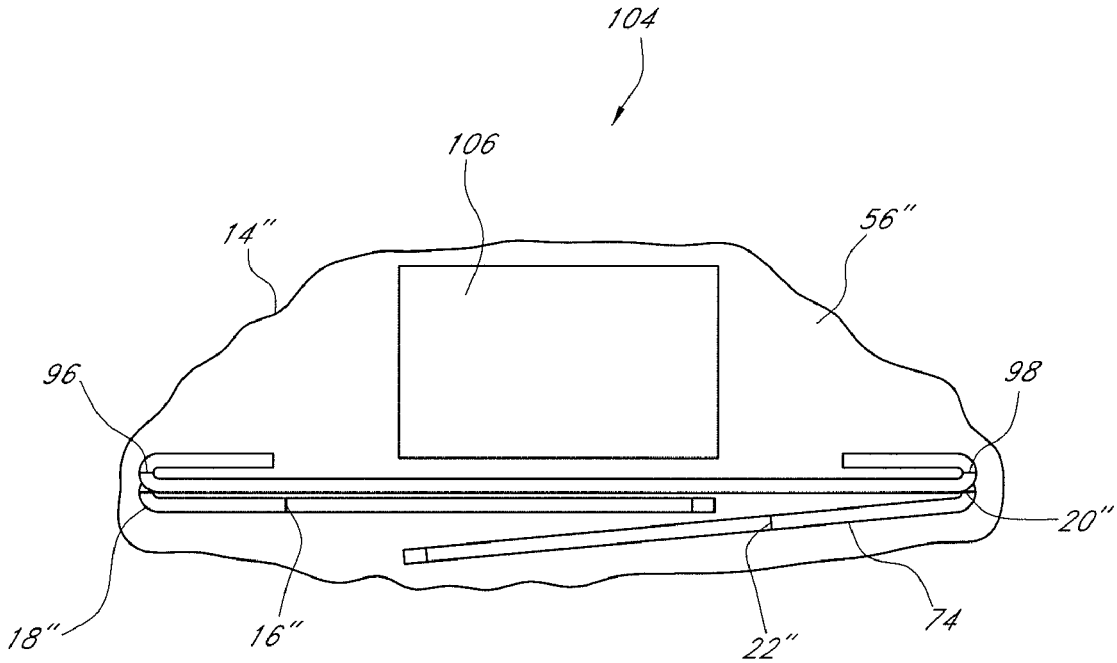
FIG. 10 is a side elevational view of the frame member shown in FIG. 9 in a folded state and inserted within a retention sleeve to form a further modification of the assembly shown in FIG. 3.
Figure 12:
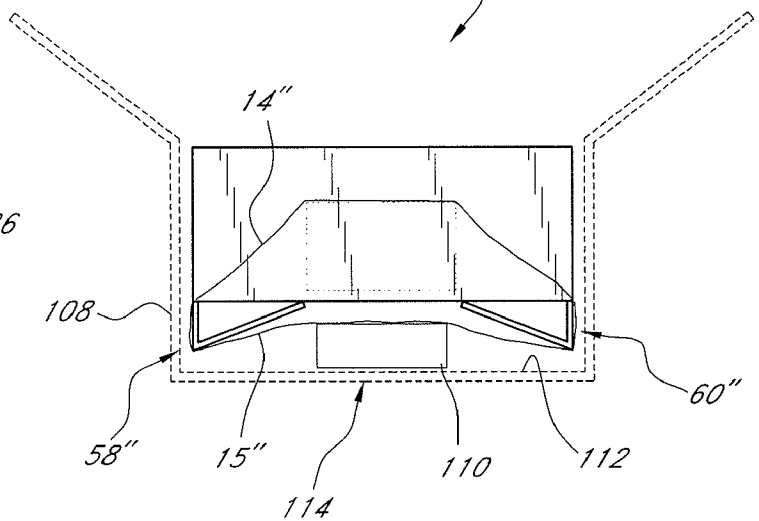
FIG. 12 is a front elevational view of a modification of the embodiment shown in FIG. 11, inserted within a box which is shown in phantom and supported above a bottom of the box by a support member.
Figure 11:
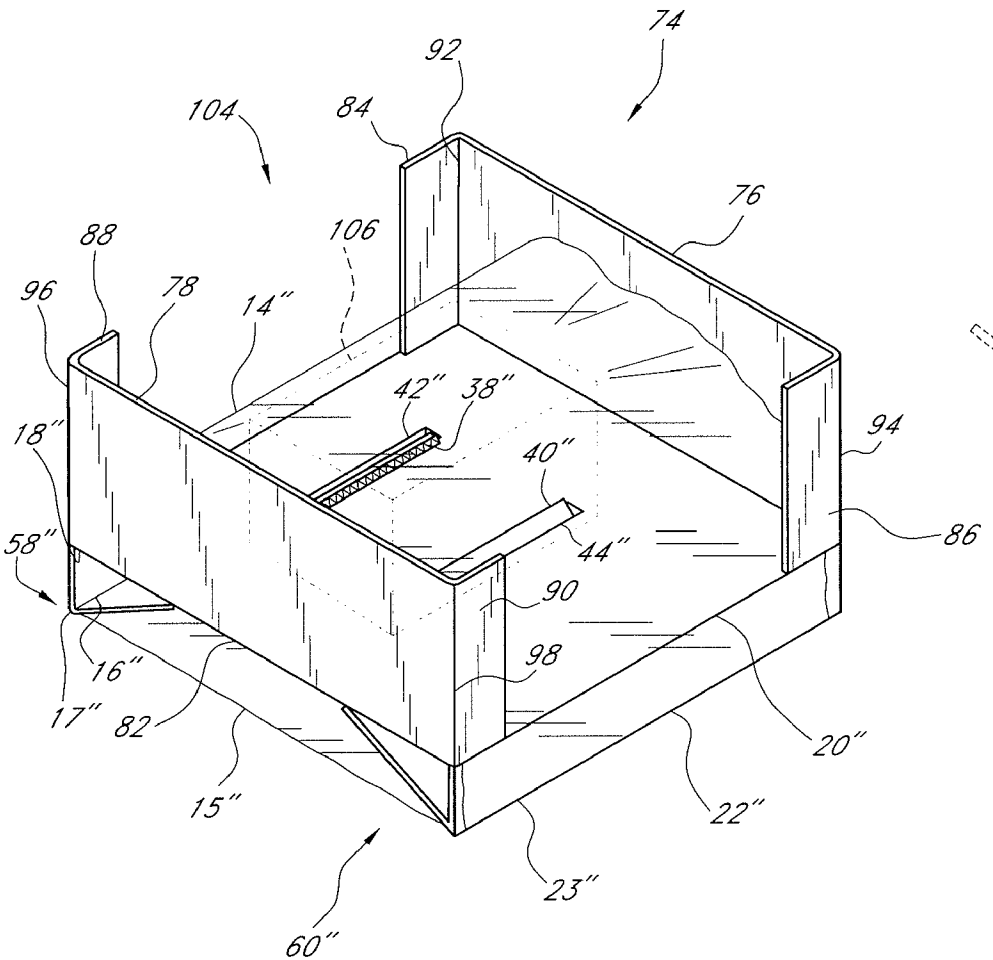
FIG. 11 is a perspective view of the assembly shown in FIG. 10 with portions of the frame member being folded so as to form two peripherally extending structures.

With reference to FIGS. 9-12, a modification of the embodiment shown in FIGS. 1-4 is shown therein. As shown in the Figures, a frame member 74 (FIG. 9) and a retention sleeve 14" (FIG. 10) cooperate to form a packaging assembly 104 (FIGS. 10-12).

With reference to FIG. 9, a frame member 74 is shown which is constructed similarly to the frame member 12 shown in FIG. 1 except as noted below. Thus, the reference numerals used to designate the various components of the frame member 74 are identical to those used for identifying the corresponding components of the frame member 12 in FIG. 1, except that a "'" as been added to the reference numerals.

As shown in FIG. 9, the inner panels 30", 32" have a slightly narrower width than the width of the inner panels 30, 32 shown in FIG. 1. Although the width of the inner panels 30", 32" is chosen according to the desired overall shape of a packaging assembly incorporating the frame member 74, the width of the inner panels 30" 32" and the proportion of those widths to the widths of the outer panels 34" 36" changes certain strength characteristics of an assembly incorporating the frame member 74.

Additionally, the frame member 74 includes side walls 76, 78 extending from the main substrate portion 24". As shown in FIG. 9, the side walls 76, 78 are connected to the main substrate portion 24" along fold lines 80, 82. Preferably, the side walls 76, 78 also include end flanges 84, 86 and 88, 90, respectively. As shown in FIG. 9, the fold lines 92, 94, 96, 98 join the end flanges 84, 86, 88, 90 to the side walls 76, 78. The end flanges 84, 86, 88, 89 are not connected to either of the inner panels 30", 32". Rather, the end flanges 84, 86, 88, 89 are separated from the inner panels 30", 32" by cut lines 96, 98, 100, 102.

It may be desirable to provide a frangible portion (not shown) of the frame member 74 connecting the end flanges 84, 86, 88, 90 to the inner panels 30", 32". Such frangible portions aid in maintaining the frame member 74 in a flat orientation prior to use. However, the frangible portions should be easily broken by hand so that when the frame member 74 is assembled for use in a packaging assembly, described below, the end flanges 84, 86, 89, 90 can be folded conveniently into the desired shape.

With reference to FIGS. 10-12, the frame member 74 can be combined with the retention sleeve 14" so as to form the packaging assembly 104. FIG. 10 illustrates an intermediate step for inserting the frame member 74 into the retention sleeve 14". When inserting the frame member 74 into the retention sleeve 14" it is desirable to fold the frame member 74 along fold lines 18", 20", 92, 94, 96, 98, as shown in FIG. 10. Preferably, as viewed in FIGS. 9 and 10, the foldable portions 26", 28" are folded downwardly along fold lines 18", 20", respectively. Additionally, the end flanges 84, 86, 88, 90 are folded upwardly along fold lines 92, 94, 96, 98, respectively to the position shown in FIG. 10. With the frame member 74 folded as such, the overall outer peripheral dimension of the frame member 74 is minimized, thus allowing the frame member 74 to be inserted into the retention sleeve 14".

With reference to FIG. 10, the retention sleeve 14" is sized to allow the frame member 74 to be received within the open end 56", as well as to allow an article 106 to be inserted through the open end 56" and between the retention sleeve 14" and the frame member 74. Additionally, the retention sleeve 14" desirably is sized such that when the projections 38", 40" are received within the receptacles 42", 44", as shown in FIG. 11, the retention sleeve 14" is tightened over the article to be packaged 106. As such, the article 106 is secured between the sleeve 14" and the frame member 74 without the use of adhesives or other permanent fasteners.

As noted above, since the sleeve 14" is not permanently affixed to the frame member 74, the sleeve 14" can be manufactured at a location geographically distant from the location where the frame member 74 is manufactured and/or from the location where various components of the assembly 104 are packaged together for final shipment to the customer who requests the packaging assembly 104.

As noted above, the frame member 74 can optionally include side walls 76, 78 attached to the main substrate 24" along fold lines 80, 82, respectively. Before the assembly 104 is inserted into a box 108, for example, the side walls 76, 78 can be folded upwardly, as viewed in FIG. 11, so as to form additional protection for the article 106. Additionally, the end flanges 84, 86, 88, 90 can be folded so as to extend normally from the walls 76, 78, thus providing additional strengthening to the overall assembly 104 and reinforcement for the walls of the box 108. As such, the assembly 104 provides additional protection for the article 106.

An additional advantage stemming from the use of the peripherally extending structures 58", 60" with the assembly 104 is that the unsupported span 15" of the retention sleeve 14" can be used to provide further cushioning of the assembly 104. For example, as shown in FIG. 12, a support member 110 can be provided on a bottom surface 112 of the box 108 such that the peripherally extending structures 58", 60" straddle the member 110, as shown in FIG. 12. Arranged as such, the unsupported span 15" of the retention sleeve is further deformed by the member 110, thus providing further tension in the sleeve 14", and suspending the assembly 104 above the bottom surface 112 of the box 108. As such, the assembly 104 is cushioned by the resiliency of the sleeve 14".

In FIG. 12, the member 110 is illustrated as a separate rectangular-shaped box. The box may contain additional goods associated with the article 106. For example, the article 106 can be a laptop computer and the member 110 can comprise books or other non-delicate materials or accessories which could support the assembly 104. The member 110 alternatively can be formed integrally with the box 108. For example, the box 108 can be formed of a piece of corrugated cardboard which is creased so as to have a rectangular cross section and with the bottom and top being formed by flaps that are bonded or taped together. The member 110 can be formed of flaps which form the bottom surface 114 of the box 108 and project into the interior of the box 108. For example, the flaps forming a bottom 114 of the box 108 can be cut such that at least one of the flaps has an additional length of cardboard which can be folded into any desired shape, such as the illustrated shape of member 110. As such, the member 110 remains fixed to the bottom wall 114 of the box 108 without the need for excessive additional adhesives or attachment devices. A more detailed description of certain alternative forms of the support member 110 will be discussed below with reference to FIGS. 35-40.

Figure 16:
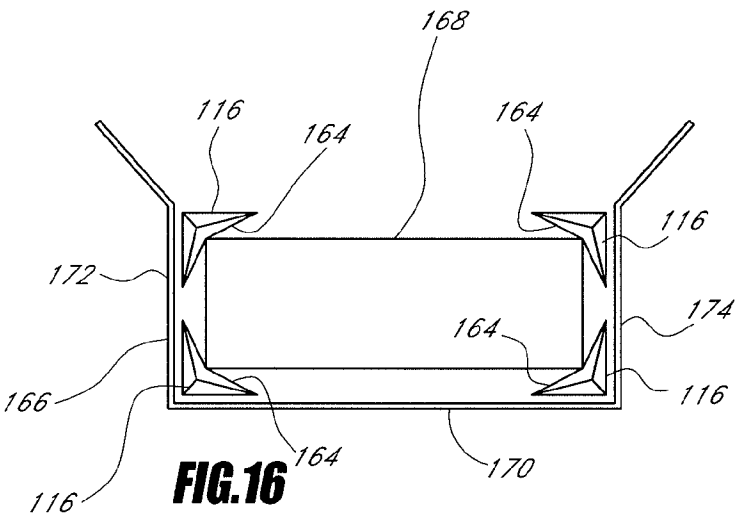
FIG. 16 is a front elevational view of four of the assemblies shown in FIG. 15 inserted within a box around an object to be packaged.
Figure 14:
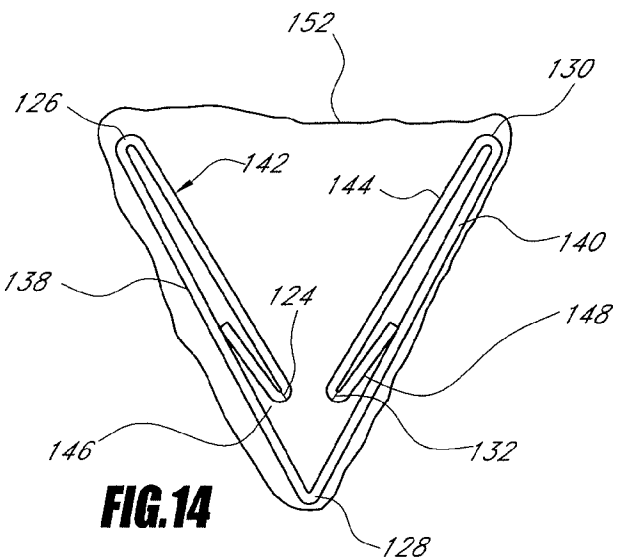
FIG. 14 is a front elevational view of the frame member shown in FIG. 13 in a folded state and inserted within a retention sleeve to form another modification of the assembly shown in FIG. 3.
Figure 13:
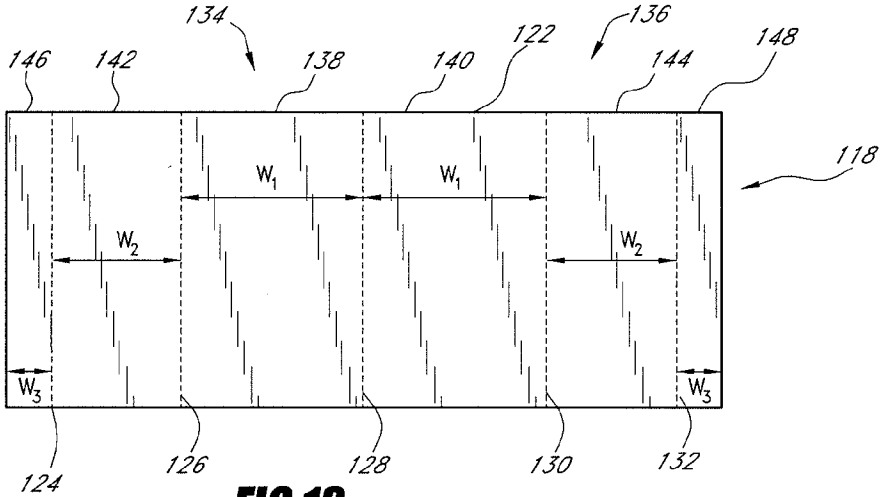
FIG. 13 is a top plan view of a frame member in an unfolded state, constructed in accordance with a further modification of the embodiment shown in FIGS. 1-4.
Figure 15:
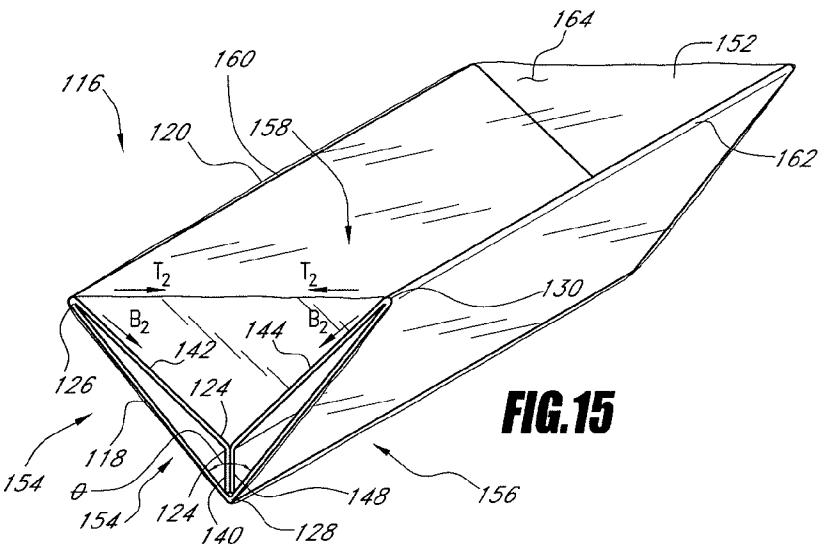
FIG. 15 is a perspective view of the assembly shown in FIG. 14 having rotatable portions of the frame member deployed so as to form peripherally extending structures within the retention sleeve.

FIGS. 13-16 illustrate a further modification of the embodiment shown in FIGS. 1-4. As illustrated in FIGS. 13-15, a frame member 118 (FIG. 13) and a retention sleeve 120 (FIGS. 14 and 15) cooperate to form a packaging assembly 116 (FIGS. 14-16).

As shown in FIG. 13, the frame member 118 is formed of a generally rectangular rigid body 122 which includes a plurality of fold lines 124, 126, 128, 130, 132. The methods and materials used to form the generally rectangular body 122 and the fold lines 124, 126, 128, 130, 132 can be the same as those described above with reference to the frame member 12 illustrated in FIGS. 1-4 and 8. As shown in FIG. 13, the fold line 128 divides the rectangular body 122 into two foldable portions 134, 136, each of which is configured to form releasably engageable peripherally extending structures within the retention sleeve 120.

As shown in FIG. 13, each of the foldable portions 134, 136 is formed of an inner panel 138, 140, an outer panel 142, 144 and an engagement portion 146, 148.

With reference to FIGS. 14 and 15, the retention sleeve 120 is constructed in accordance with the description set forth above with respect to the retention sleeve 14 illustrated in FIGS. 1-4 and 8. In the illustrated embodiment shown in FIGS. 13-16, the retention sleeve 120 includes a first open end 150 and a second open end 152. Additionally, in the illustrated embodiment, the retention sleeve 120 is sized to allow the frame member 118 to be inserted through one of the open ends 150, 152 when the frame member 118 is in the folded state shown in FIG. 14.

As shown in FIG. 14, the frame member 118 is folded along fold lines 124, 126, 128, 130, 132 such that one engagement portion 146 is folded between the inner panel 138 and the outer panel 142 and the other engagement portion 148 is folded between the inner panel 140 and the outer panel 144. Preferably, the sleeve 120 is sized to allow the frame member 118 to be inserted easily into one of the free ends 150, 152 of the sleeve 120 when the frame member 118 is folded in the manner illustrated in FIG. 14.

In order to tighten the sleeve 120, the engagement portions 146, 148 can be partially unfolded so as to form releasably engageable peripherally extending structures 154, 156. In the illustrated embodiment, the peripherally extending structures 154, 156 are triangular. However, as noted above with respect to the peripherally extending structures 58, 60 illustrated in FIGS. 3 and 8, the peripherally extending structures 154, 156 can have any peripherally extending shape, including, but without limitation, cylindrical, tubular, square, rectangular, circular, and the like.

With the peripherally extending structures 154, 156, formed with a triangular shape, the structures 154, 156 are provided with the inherent structural rigidity of a triangular shape, which enhances the overall structural rigidity of the assembly 116. The tension generated by the arrangement of the folding portions 134, 136 into the peripherally extending structures 154, 156, respectively, can be varied by changing the overall length of the panels 138, 140, 142, 144, 146, 148 which form the frame member 118. In the illustrated embodiment, the panels 138, 140 have a width $W_1$, the panels 142, 144 have a width $W_2$, and panels 146, 148 have a width $W_3$. As shown in the figures, the $W_3$ is smaller than the width $W_2$. Thus, as shown in FIG. 15, the peripherally extending structures 154, 156 form a V-shaped recess 158 therebetween.

The recess 158 is arranged between the peripherally extending structures 154 and 156. Additionally, the portions of the frame member 118 along the fold lines 126, 128 define free edges 160, 162, between which an unsupported span 164 of the retention sleeve 120 extends above the recess 158.

With reference to FIG. 16, a shipping container such as a box 166 is shown having an article to be packaged 168 supported by four packaging assemblies 116 arranged between the inner walls 170, 172, 174 and the article 168. As shown in FIG. 16, the article 168 contacts the unsupported span 164 of each of the retention sleeves 120 of the corresponding packaging assemblies 116. Thus, the recess 158 defined between each of the peripherally extending structures 154, 156 allows the unsupported span 164 to flex during use, such as for packaging the article 168 in the box 166, thereby providing a cushioning effect for the article 168.

As shown in FIG. 16, the assembly 116 can be placed in a variety of locations within the box 166. Although not shown in FIG. 16, additional assemblies 116 can be provided around the other edges of the article 168 and the box 166, to provide further cushioning effect. Additionally, it should also be noted that due to the structure of the assembly 116, the assembly 116 can be used with various and unusually shaped articles and thus can be arranged in various locations within a shipping container such as the box 166.

When the assemblies 116 are used in the interior corners of a container such as the box 166, which has right angles, it is advantageous to configure the relative widths $W_1$, $W_2$, $W_3$ such that the inner panels 138, 140 form an angle θ (FIG. 15) that is approximately equal to 90°. Thus, when the assemblies 116 are used in the manner illustrated in FIG. 16, i.e., arranged such that the inner panels 138, 140 lie against perpendicular walls of the box 166, the assemblies 116 are stabilized by the perpendicular interior walls. However, the relative widths $W_1$, $W_2$, $W_3$ can be adjusted, as is apparent to one of ordinary skill in the art, such that the angle θ between the inner panels 138, 140 corresponds to other angles, which may be advantageous for shipping containers having other shapes.

In the illustrated embodiment, the folding portions 134, 136 are configured such that the engaging portions 146, 148 act against each other when the folding portions 134, 136 are folded into the peripherally extending structures 154, 156 illustrated in FIG. 15. As such the peripherally extending structures 154, 156 are releasably engageable. It is conceived that an additional member can be placed between the engagement portions 146, 148, without substantially altering the engaging effect produced when the folding portions 134, 136 are folded as illustrated in FIG. 15. Additionally, the sizing of the retention sleeve 120 also helps the folding portions 134, 136 remain in the folded position illustrated in FIG. 15.

For example, the retention sleeve 120 is preferably sized such that when the foldable portions 134, 136 are folded into the peripherally extending structures 154, 156, tension is generated in the sleeve 120. The tension acts in the directions indicated by arrows $T_2$. Thus, forces $B_2$ transferred to the peripherally extending structures 154, 156 urge the engaging portions 146, 148 toward each other, helping to maintain the folding portions 134, 136 in the folded position shown in FIG. 15. Once a user has folded the folding portions 134, 136 into the peripherally extending structures 154, 156, the assembly 116 maintains the position shown in FIG. 15.

As noted above, since the retention sleeve 120 is not permanently affixed to the frame member 118, the assembly 116, the manufacturing of these individual components can be performed at facilities that are located geographically distant from each other.

Additionally, by configuring the peripherally extending structures 154, 156 to form the V-shaped recess 158 therebetween, the assembly 116 can be used in a variety of locations within a shipping container, such as the box 166. Thus, the assembly 116 provides enhanced flexibility in the way the assemblies 116 are used to package an article to be shipped. For example, since a user can use any number of assemblies 116 to package a particular product, and since the assemblies 116 can be used with a wide variety of differently-shaped products, i.e., the assemblies 116 can be used to support an edge or a corner of a product, the total number of different components to be kept in stock is reduced.

With reference to FIGS. 17-22, a further embodiment of the packaging assembly of the present invention is shown therein. The packaging assembly according to the present embodiment includes a frame member 180 (FIG. 17), a retention member 182 (FIG. 18) which cooperate with each other to form the packaging assembly 184 as illustrated in FIGS. 19-22.

Figure 17:
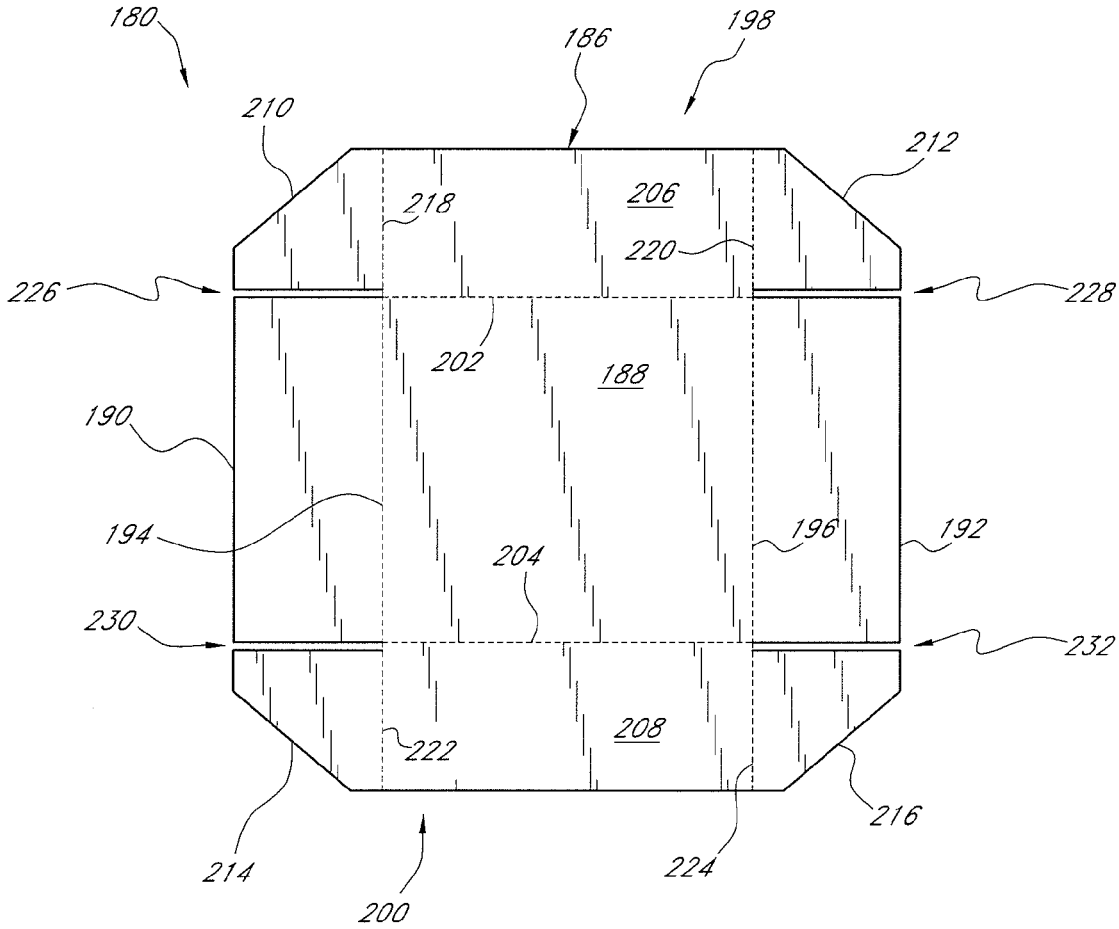
FIG. 17 is a top plan view of a frame member in an unfolded state, constructed in accordance with an embodiment of a further aspect of the present invention.

As shown in FIG. 17, the frame member 180 is formed of a rigid body member 186. In the illustrated embodiment, the rigid body 186 is generally rectangular. However, it will be apparent to one of ordinary skill in the art that the rigid body 186 can be formed in various other shapes according to the desired overall characteristics of the packaging assembly 184. As shown in FIG. 17, the rigid body 186 includes a main substrate portion 188 having a first rotatable portion 190 and a second rotatable portion 192, each being connected to the main substrate portion 188 at fold lines 194, 196, respectively. The construction of the rigid body 186 and the fold lines 194, 196, as well as other fold lines included on the rigid body 196 discussed below, can be constructed in accordance with the description of the frame member 14 illustrated in FIGS. 1-4 and 8.

As shown in FIG. 17, the rigid body 186 includes side walls 198, 200 which are connected to the main substrate portion 188 along fold lines 202, 204, respectively. The side walls 198, 200 are each divided into a main panel 206, 208 and side panels 210, 212, 214, 216. The side panels 210, 212 are connected to the main panel 206 at fold lines 218, 220, respectively. Similarly, the side panels 214, 216, are connected to the main panel 208 at fold lines 222, 224, respectively.

Preferably, clearances 226, 228, 230, 232 are formed between the side panels 210, 212, 214, 216, and the rotatable portions 190, 192. The clearances 226, 228, 230, 232 provide gaps between the rotatable portions 190, 192 and the side panels 214, 216 such that when a user rotates the rotatable portions 190, 192 around the fold lines 194, 196, respectively, the rotatable portions 190, 192 rotate freely and thus, are not impeded by the side panels 210, 212, 214, 216.

Figure 18:
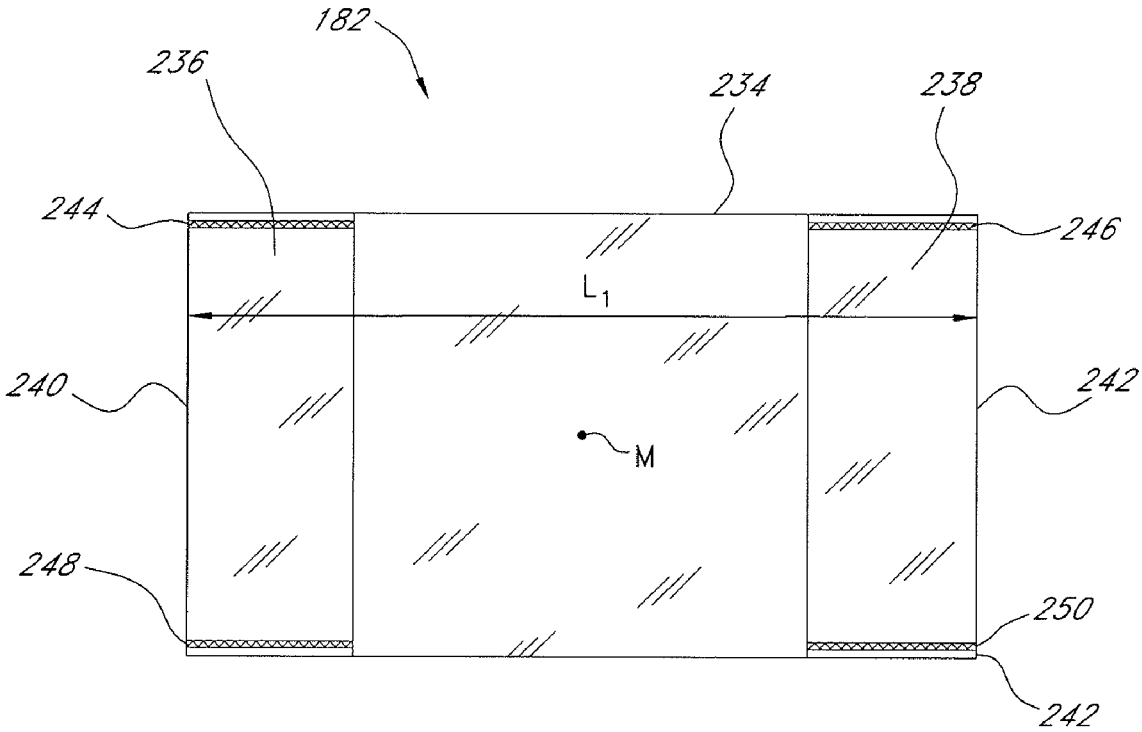
FIG. 18 is a top plan view of a retention member having pockets for use with the frame member shown in FIG. 17.

With reference to FIG. 18, a retention member 182 is illustrated therein. The retention member 182 is preferably formed of a resilient body 234 having and mid-point M positioned in the vicinity of the middle of the resilient body 234. The resilient body 234 also includes pockets 236, 238 at opposite ends thereof. In the illustrated embodiment, the retention member 182 is formed from a single piece of resilient material, in accordance with the construction of the retention member 14 set forth above with respect to FIGS. 2-4 and 8. The retention member 182 differs from the retention member 14, however, in that the retention member 182 includes the pockets 236, 238.

In the illustrated embodiment, the pockets 236, 238 are formed of folds 240, 242 formed in the resilient body 234 which have been attached (e.g., heat sealed) along lateral opposite edges thereof along heat sealing lines 244, 246, 248, 250. The heat sealing lines can be continuous or formed of a plurality of heat sealed points. One of ordinary skill in the art will appreciate that there are numerous methods for forming pockets in a resilient sheet material such as the resilient body 234. However, it has been found that heat sealing is particularly advantageous as it does not require expensive adhesives and the time consuming steps required for using adhesives.

Figure 19:
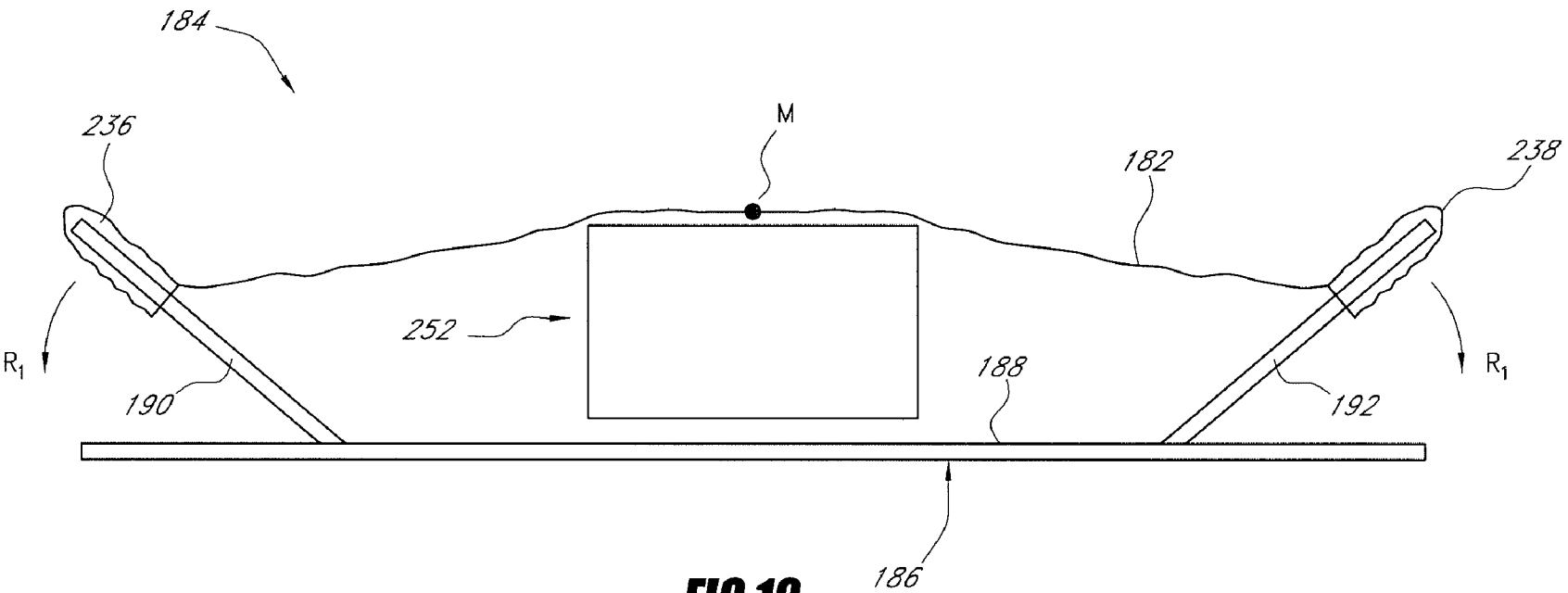
FIG. 19 is a front elevational view of the frame member shown in FIG. 17 in a folded state and the retention member shown in FIG. 18 with rotating portions of the frame member inserted within the pockets of the retention member to form a packaging assembly constructed in accordance with an embodiment of the present aspect of the invention, with an article to be packaged placed between the frame member and the retention member.

With reference to FIG. 19, the assembly 184 is shown with the rotatable portions 190, 192 of the frame member 186 received within the respective pockets 236, 238. In the orientation shown in FIG. 19, the rotatable portions 190, 192 have been rotated upwardly, as viewed in FIGS. 17 and 19, and the pockets 236, 238 have been fit over the rotatable portions 190, 192. Preferably, the retention member 182 is sized such that a length L1 (FIG. 18) allows the retention member 182 to be moved between a slackened position, as illustrated in FIG. 19, and a tightened position as illustrated in FIG. 20.

As shown in FIG. 19, when the assembly 184 is in the slackened position illustrated therein, an article to be packaged 252 can be inserted between the retention member 182 and the main panel 188 of the frame member 186. Thereafter, at least one, and preferably both of the rotatable portions 190, 192 can be rotated away from the midpoint M, in the direction indicated by arrows R until the retention member 182 is tightened, as illustrated in FIG. 20. Thus, it is advantageous that the length $L_1$ of the retention member 182 is configured such that the retention member 182 can be moved between a slackened position as illustrated in FIG. 19 and a tightened position illustrated in FIG. 20 in which the article 252 is appropriately secured in place on the main panel 188 of the frame member 180.

Figure 20:
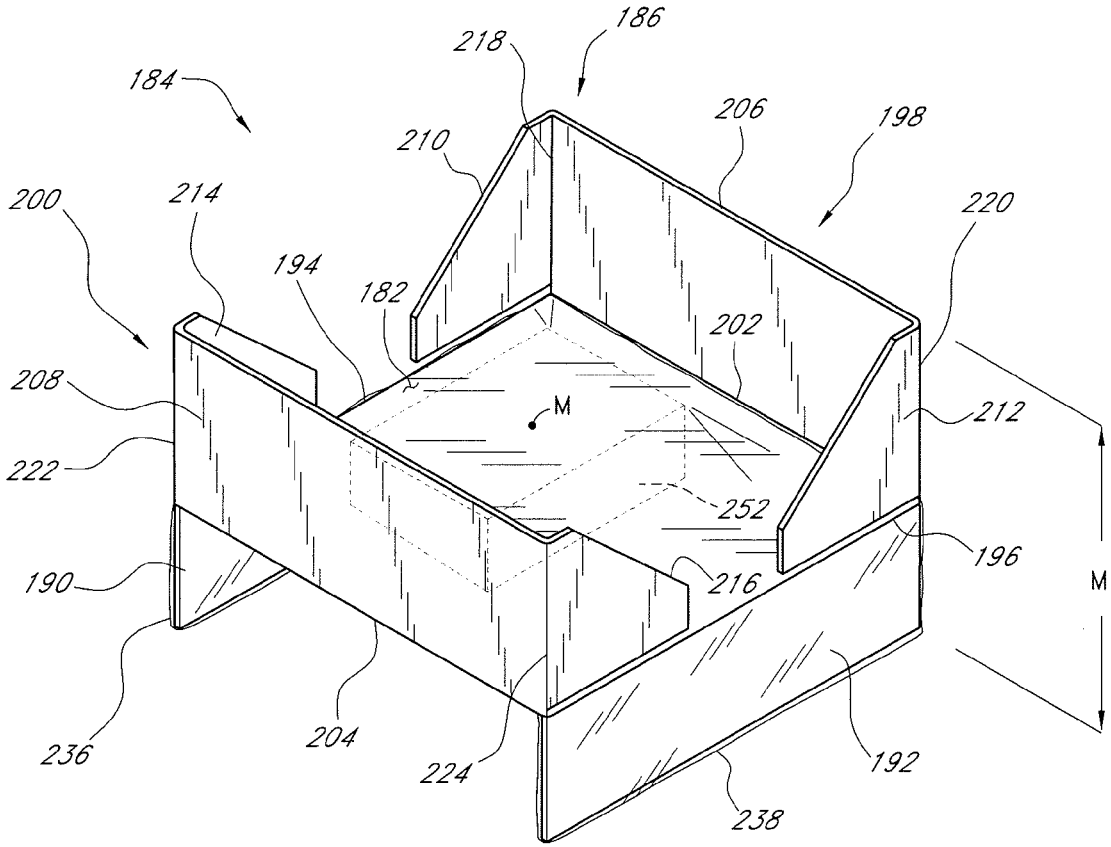
FIG. 20 is a perspective view of the assembly shown in FIG. 19, with the rotatable portions of the frame member rotated downwardly so as to tighten the retention member over the article to be packaged and with side walls of the frame member folded upwardly.

With reference to FIG. 20, as noted above, the frame member 180 can include side walls 198, 200. As shown in FIG. 20, the side walls 198, 200 can be folded upwardly so as to provide further protection for the article 252. In the illustrated embodiment, the side walls 198, 200 have been folded upwardly along fold lines 202, 204, respectively. Additionally, the side panels 210, 212 have been folded inwardly, as viewed in FIG. 20, along fold lines 218, 220, respectively. Similarly, side panels 214, 216 have been folded inwardly along fold lines 222, 224, respectively. In this position, the assembly 184 defines a maximum overall height H.

By constructing the assembly 184 as such, the embodiment according to the present aspect of the invention achieves several advantages over the prior art. For example, since the retention member 182 is not permanently bonded to the frame member 180, the retention member can be manufactured at a distant geographic location, as discussed above with respect to the embodiments of FIGS. 1-16. Additionally, by forming the retention member with pockets 236, 238, and by engaging the pockets 236, 238 with at least one rotatable portion 190, 192, of the frame member 180, the assembly 184 provides great flexibility with respect to the sizes of articles to be packaged which can be placed between the retention member 182 and the main panel 188 of the frame member 180.

For example, as shown in FIG. 19, the rotatable portions 190, 192 can be folded upwardly such that a large opening can be formed between the retention member 182 and the surface of the main panel 188 upon which the package 252 is placed. Thus, the assembly 184 can be used with articles of various sizes.

Figure 21:
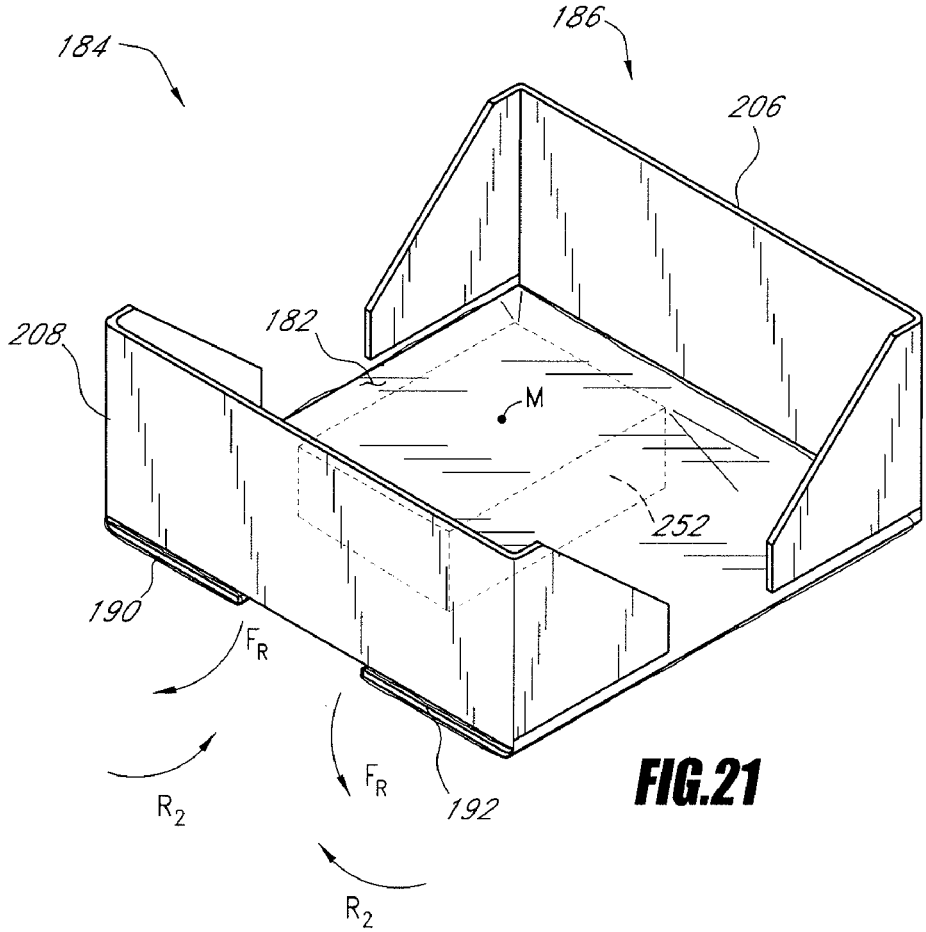
FIG. 21 is a perspective view of a modification of the assembly shown in FIG. 20, with the rotatable portions of the frame member folded to a more extreme angle so as to form additional cushions of the assembly.

With reference to FIG. 17, by providing clearances 226, 228, 230, 232 between the rotatable portions 190, 192 and the end panels 210, 212, 214, 216, the rotatable portions 190, 192 can be easily rotated from the position shown in FIG. 19 to the position shown in FIGS. 20 and 21 without contacting the end panels 210, 212, 214, 216, particularly when the pockets 236, 238 of the retention member 182 are engaged with the rotatable portions 190, 192, respectively.

Figure 22:
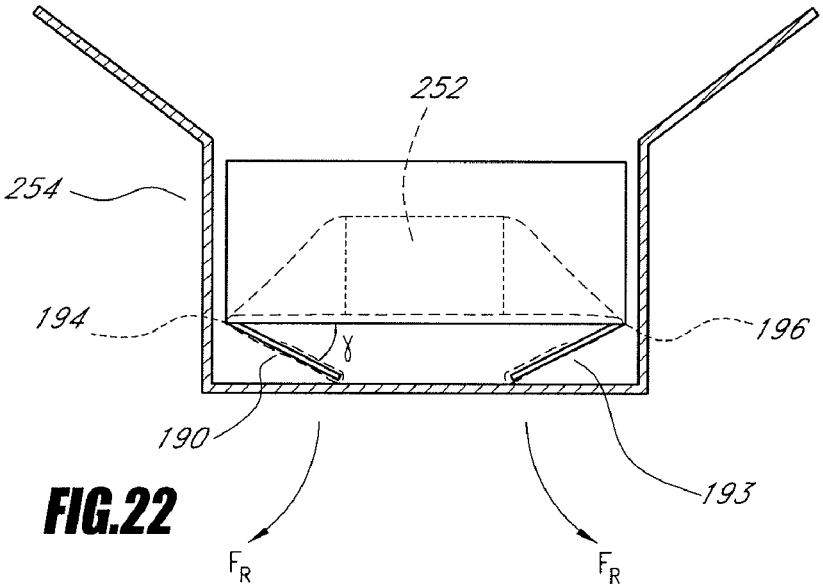
FIG. 22 is a side elevational view of the assembly shown in FIG. 21, inserted into a box which is shown in section.

With reference to FIGS. 21 and 22, the length $L_1$ of the retention member 182 optionally can be configured such that the rotatable portions 190, 192 and the retention member 182 itself forms a further cushioning device or a spring. For example, as shown in FIGS. 21 and 22, the rotatable portions 190, 192 have been rotated in the direction of arrows $R_2$ from the position illustrated in FIG. 20, to an angle $\gamma$ which is substantially smaller than 90°. With the rotatable portions 190, 192 rotated to such a position, further tension can be generated in the retention member 182 thus causing a reaction force to bias the rotatable portions 190, 192 in the direction of arrow $F_R$. Where the frame member 180 is formed of cardboard, the reaction forces along the arrows $F_R$ are further enhanced due to the tendency of cardboard to return to an unfolded state, despite the formation of fold lines, such as the fold lines 194, 196, i.e., the "fibrous memory" of cardboard creates a cantilever-type spring effect. Accordingly, when the assembly 184 is positioned within a shipping container such as a box 254 (FIG. 22), the reaction force $F_R$ provides additional cushioning to the article 252. Thus, the length $L_1$ of the retention member 182 can be configured such that the rotatable portions 190, 192 and the retention member 182 form a spring, thus providing a reaction force and cushioning for the article 252.

Figure 22A:
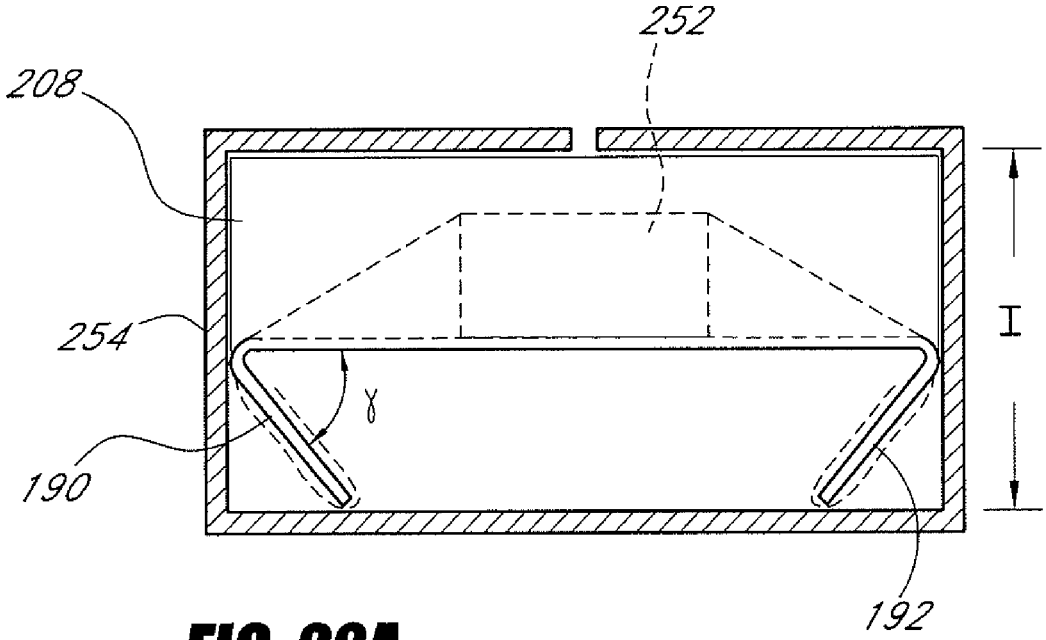
FIGS. 22A and 22B illustrate different positions of the assembly within the box illustrated FIG. 22.
Figure 22B:
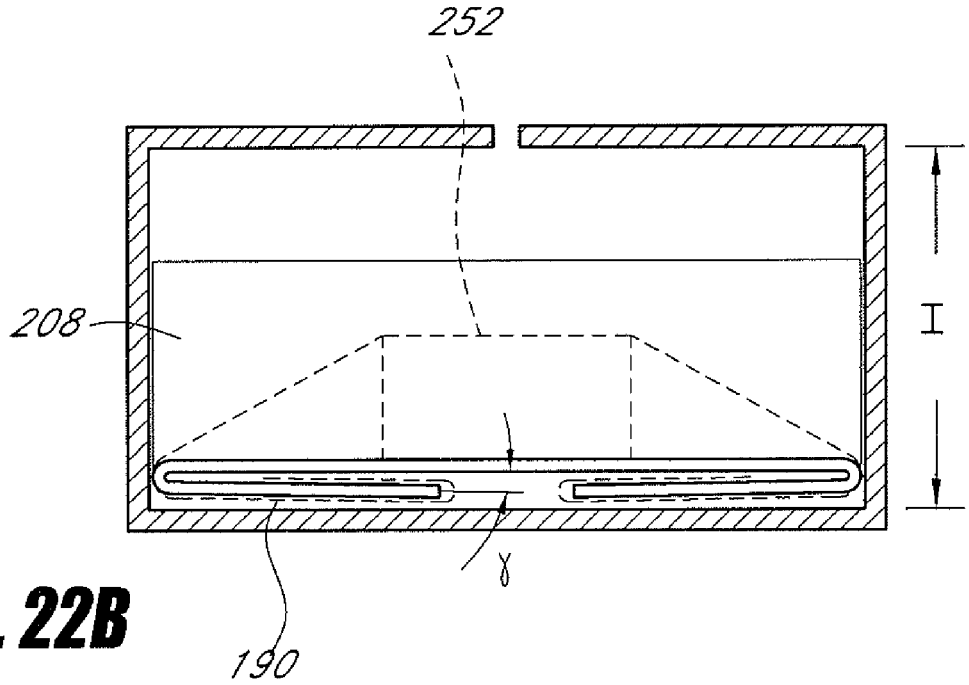

With reference to FIGS. 22A and 22B, the box 254 defines a maximum inner height I. Preferably, the maximum inner height I of the box 254 is less than the maximum overall height H (FIG. 20) of the assembly 184. As such, the rotatable portions 190, 192 are maintained in an angular position such that the angle $\gamma$ remains substantially smaller than 90°, as illustrated in FIGS. 22A and 22B.

For example, as the box 254 is subjected to impacts and shocks, particularly in the vertical direction, as viewed in FIGS. 22, 22A, and 22B, the assembly 184 moves between the maximum vertical position in the box 254, illustrated in FIG. 22A, and the minimum vertical position illustrated in FIG. 22B. As the assembly 184 moves between the minimum and maximum vertical positions within the box 254, the rotatable portions 190, 192 rotate according to the movement of the assembly, i.e., the rotatable portions 190, 192 rotate inwardly as the assembly 184 moves downwardly in the box 254 and outwardly as the assembly moves upwardly in the box 254, as viewed in FIGS. 22A and 22B. The bias provided by the retention member 182 and/or the resistance provided by the fold lines 194, 196 absorbs shocks transferred to the box 254, thus further cushioning the article 252.

Figure 24:
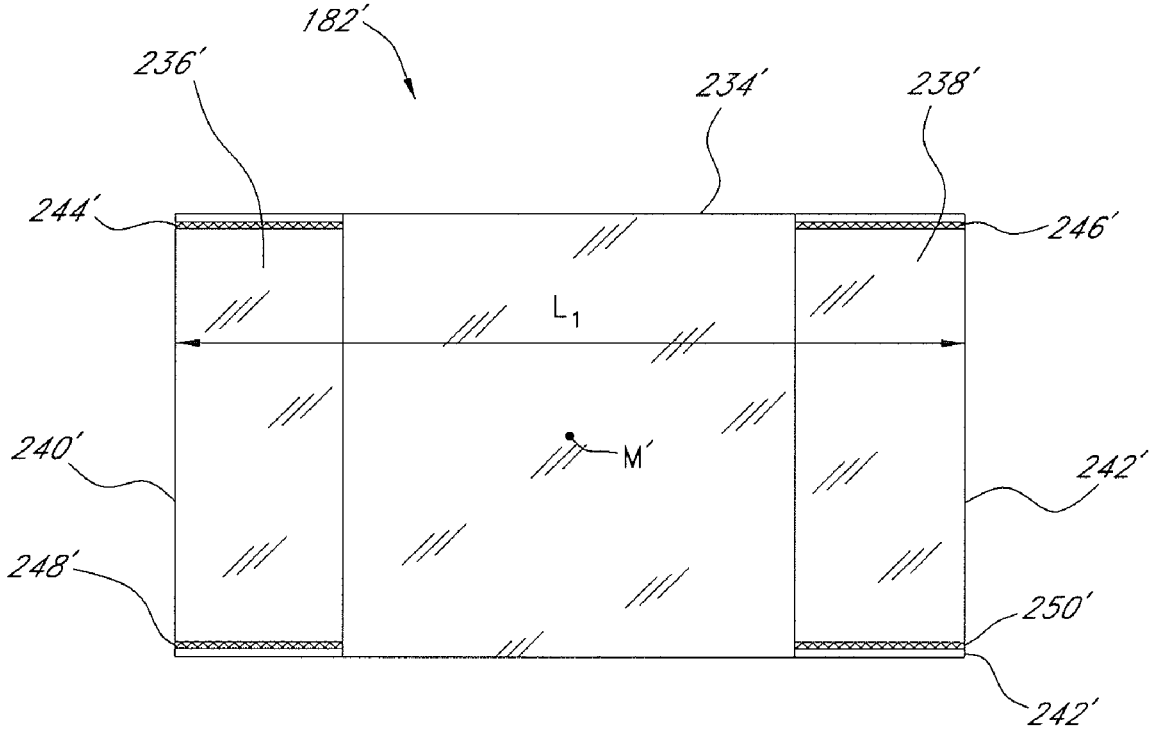
FIG. 24 is a plan view of a retention member having pockets for use with the frame member shown in FIG. 23.
Figure 25:
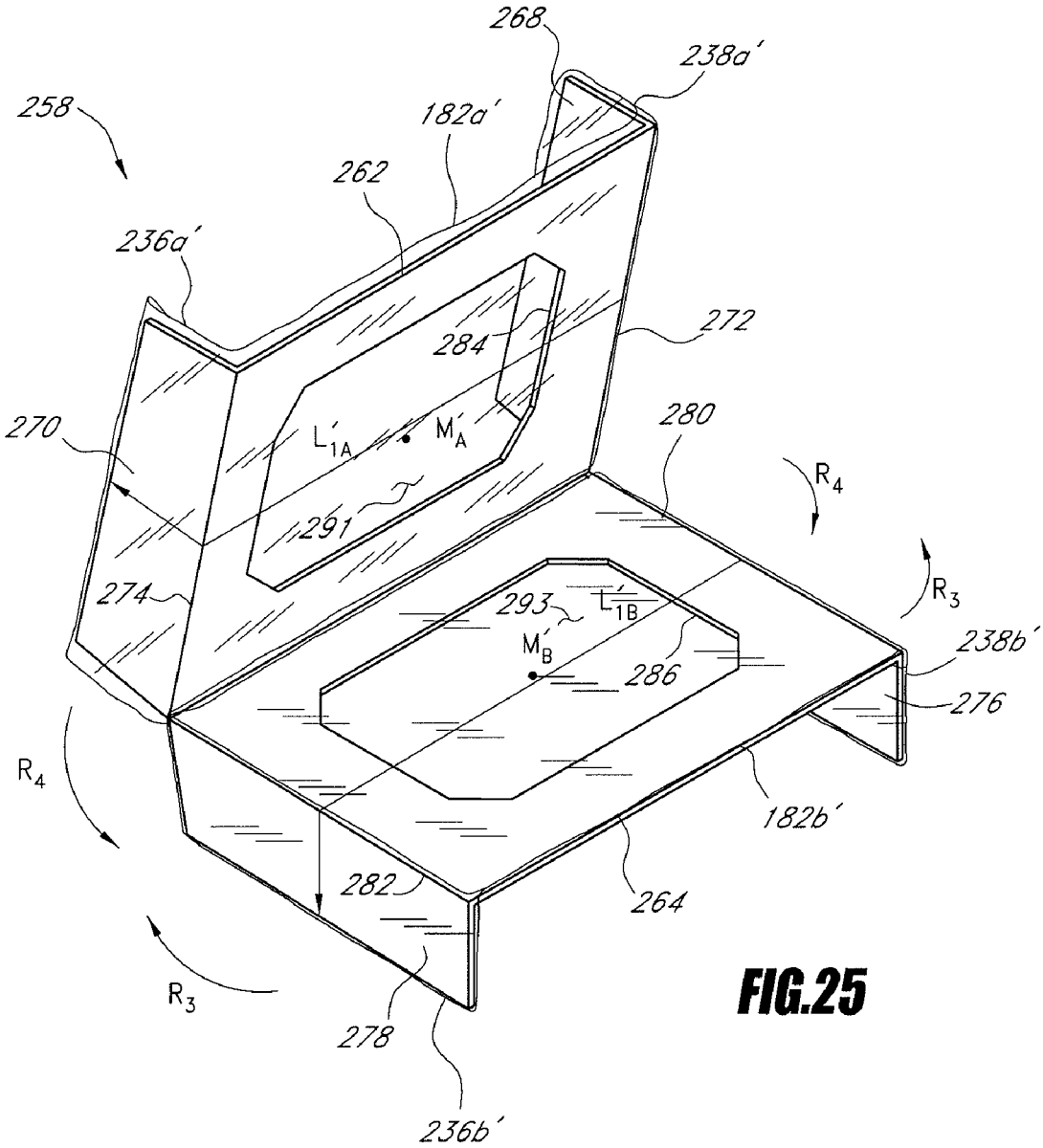
FIG. 25 is a perspective view of the frame member shown in FIG. 23 in a partially folded state with two of the retention members shown in FIG. 24 assembled with the frame member such that the rotatable portions of the frame member shown in FIG. 23 are inserted into the pockets of the retention members to form a further modification of the assembly shown in FIG. 20.
Figure 26:
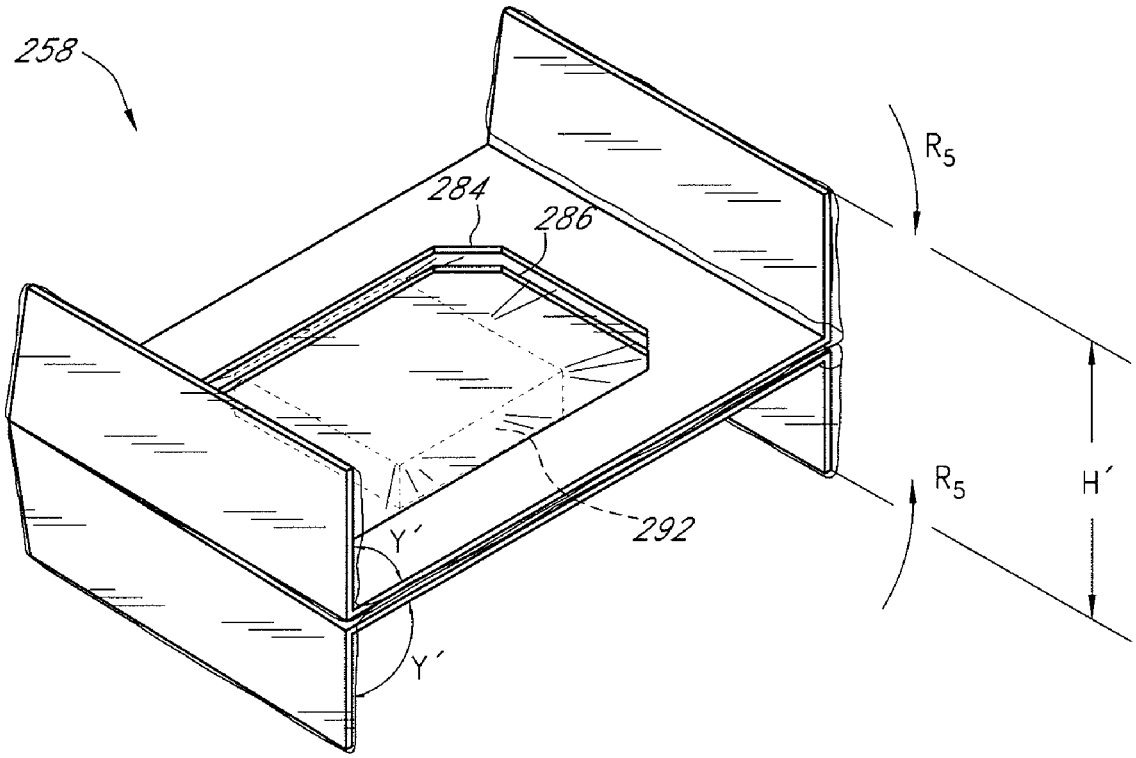
FIG. 26 is a perspective view of the assembly shown in FIG. 25 with the frame member folded to a more extreme state and with an article to be packaged disposed between unsupported portions of the retention members.

With reference to FIGS. 23-26, a modification of the embodiment shown in FIGS. 17-22 is illustrated therein. As shown in the figures, a frame member 256 (FIG. 23) and two retention members 182' (FIG. 24) cooperate to form a packaging assembly 258, as illustrated in FIG. 26.

Figure 23:
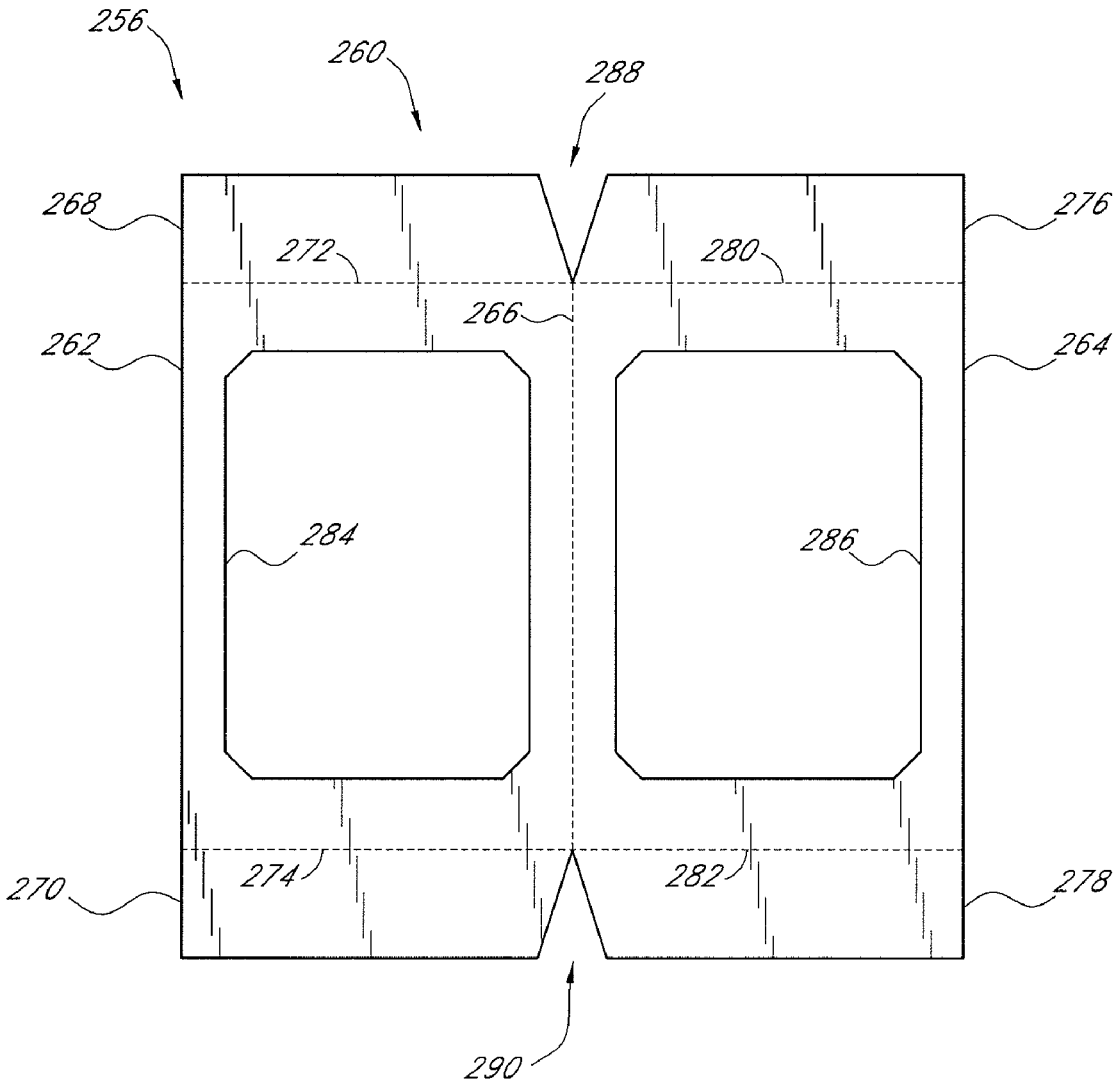
FIG. 23 is a top plan view of a frame member in an unfolded state having rotatable portions constructed in accordance with a modification of the embodiment shown in FIGS. 17-20.

As shown in FIG. 23, the frame member 256 is formed of a rigid body 260 having first and second panel members 262, 264 connected along a fold line 266. The first panel portion 262 includes first and second rotatable portions 268, 270 which are connected to the first panel portion 262 along fold lines 272, 274, respectively. Similarly, first and second rotatable portions 276, 278 are connected to the second panel portion 264 along fold lines 280, 282, respectively. The construction of the rigid body 260 and the fold lines 266, 272, 274, 280, 282 is preferably in accordance with the description of the frame member 180 illustrated in FIGS. 17 and 19-21.

In the illustrated embodiment, as shown in FIG. 23, the first and second panel members 262, 264 include apertures 284, 286. The apertures 284, 286 are in the form of through holes formed in the first and second panel members 262, 264, respectively. Additionally, the frame member 256 is provided with a notch 288 provided between the rotatable portions 268 and 276. The notch 288 provides clearance between the rotatable portions 268, 276. Similarly, the frame member 256 includes a notch 290 formed between the rotatable portions 270, 278. The function of the notches 288, 290 will be described below.

With reference to FIG. 24, the retention member 182' is constructed in accordance with the retention member illustrated in FIG. 18. Thus, the various components of the retention member 182' are indicated with the same reference numerals used in FIG. 18, except that a "'" has been added to those reference numerals set forth in FIG. 24. Thus, further explanation of the various components of the retention member 182' is not believed to be necessary for one of ordinary skill in the art to practice the invention. However, the configuration of the retention member 182' as part of the assembly 258 will be described below.

With reference to FIG. 25, as noted above, the assembly 258 includes two retention members 182', each engaged with one of the panel members 262, 264. Thus, for clarity, the retention member labeled as $\mathbf{182}_A$' is illustrated as engaged with the first panel member 262 and a second retention member labeled as $\mathbf{182}_B$' is illustrated as engaged with the second panel member 264. As shown in FIG. 25, the rotatable portions 268, 270 are received within the pockets $\mathbf{238}_A$', $\mathbf{236}_A$'. Similarly, the rotatable portions 276, 278 are received within the pockets $\mathbf{238}_B$', $\mathbf{236}_B$'. As such, unsupported spans 291, 293 of the retention members $\mathbf{182}_A$', $\mathbf{182}_B$', respectively are formed over the apertures 284, 286, respectively.

As noted above with respect to FIG. 24, the retention members $\mathbf{182}_A$', $\mathbf{182}_B$' have lengths $L_{1A}$', $L_{1B}$', respectively, which are configured such that the rotatable portions 268, 270, and 276, 278 can be moved between positions in which the retention members $\mathbf{182}_A$', $\mathbf{182}_B$' are slackened and positions in which the retention members $\mathbf{182}_A$', $\mathbf{182}_B$' are tightened. For example, although not illustrated, the rotatable portions 276, 278 shown in FIG. 25, can be rotated upwardly towards the mid-point $M_B$' in the directions indicated by arrows $R_3$. With the rotatable portions 276, 278 rotated to such a position, the pockets $\mathbf{238}_B$', $\mathbf{236}_B$' can easily be slid over the rotatable portions 276, 278. Afterwards, the rotatable portions 276, 278 can be rotated away from the $M_B$' in the direction indicated by arrows $R_4$, to the position illustrated in FIG. 25. In this position, the retention member $\mathbf{182}_B$' is tightened across the second panel member 264. Thus, it is advantageous to configure the length $L_{1B}$' of the retention member $\mathbf{182}_B$' to produce the desired tension when the rotatable portions 276, 278 are rotated to the position shown in FIG. 25.

It is apparent to one of ordinary skill in the art that the length $L_{1B}$' can be adjusted accordingly to generate the desired tension and in light of the overall strength of the frame member 256 and the strength of the retention member $\mathbf{182}_B$'. It is to be noted that the present procedure for engaging the pockets $\mathbf{238}_B$', $\mathbf{236}_B$' with the rotatable portions 276, 278 is generally the same procedure used to engage the pockets $\mathbf{238}_A$', $\mathbf{236}_A$' with the rotatable portions 268, 270.

As shown in FIG. 26, with the retention member $\mathbf{182}_A$' engaged with the first panel member 262 and the retention member $\mathbf{182}_B$' engaged with the second panel member 264, an article to be packaged 292 can be placed between the retention members $\mathbf{182}_A$', $\mathbf{182}_B$' and generally aligned with the apertures 284, 286 formed in the first and second panel members 262, 264, respectively. As such, when the first and second panel members 262, 264 are rotated towards each other, in the directions indicated by arrows $R_5$, such that the article 292 is disposed between the retention members $\mathbf{182}_A$', $\mathbf{182}_B$'. As such, the unsupported spans 291, 293 of the retention members $\mathbf{182}_A$', $\mathbf{182}_B$' protrude through the apertures 284, 286, respectively and thereby substantially envelope the article 292 within the respective retention members $\mathbf{182}_A$', $\mathbf{182}_B$'. Thus, the article 292 can be solely suspended by the retention members $\mathbf{182}_A$', $\mathbf{182}_B$' without contacting the frame member 256. Accordingly, the cushioning effect and vibration dampening provided by the assembly 258 are determined largely by the mechanical characteristics of the material used to form the retention members $\mathbf{182}_A$', $\mathbf{182}_B$' and partially to the overall mechanical characteristics of the frame member 256.

With reference to FIG. 26, when the rotatable portions 268, 270 and 276, 278 are oriented such that they form an angle γ' of approximately 90° with the main panel portions 262, 264, respectively, the assembly 258 defines a maximum overall height H'. As noted above with reference to FIGS. 20, 22A, and 22B, the rotatable portions 268, 270, 276, 278 can be further folded along the fold lines 272, 274, 280, 282, respectively, away from the mid-points $M_A$', $M_B$' such that the angles γ' are substantially smaller than 90°, thereby forming springs. As such, the assembly 258 can be inserted into a box with a maximum inner height that is less than H', thus maintaining the rotatable portions 268, 270, 276, 278 at angles γ' that are substantially smaller than 90°.

As noted above, since the retention members $\mathbf{182}_A$', $\mathbf{182}_B$' are not permanently affixed to the frame member 256, the retention members $\mathbf{182}_A$', $\mathbf{182}_B$' can be manufactured at a distant geographical location. Additionally, the retention members $\mathbf{182}_A$', $\mathbf{182}_B$' can be easily removed and recycled or reused with other packaging assemblies, thus reducing the burden in terms of refuse and disposal costs.

Figure 27:
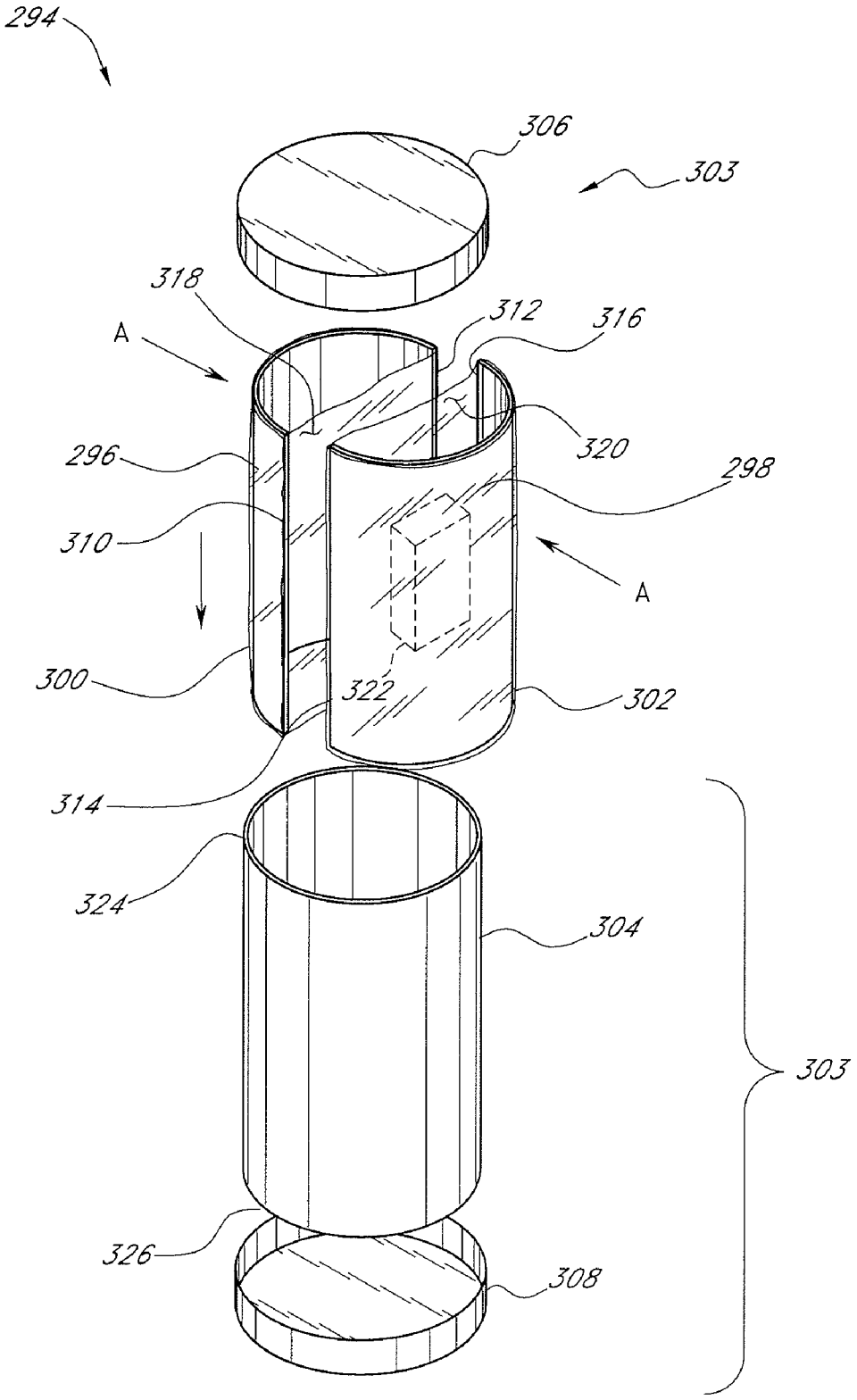
FIG. 27 is an exploded view of an embodiment of an additional aspect of the present invention, illustrating two semicircular members inserted within corresponding retention sleeves, a cylindrical housing, and two cap members.
Figure 28:
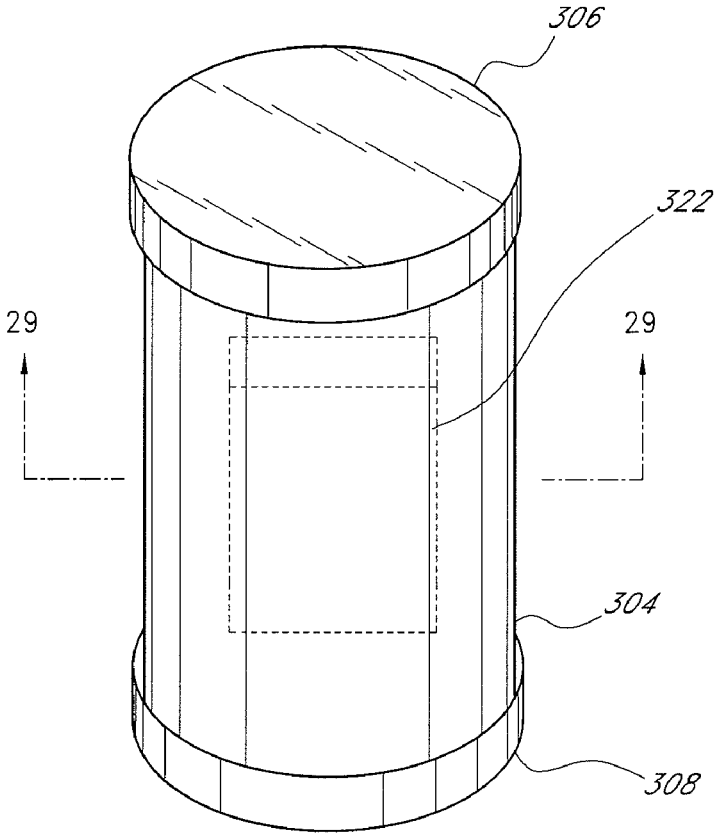
FIG. 28 is a perspective view of the assembly shown in FIG. 27 in an assembled state with an article to be packaged within the assembly shown in phantom.
Figure 29:
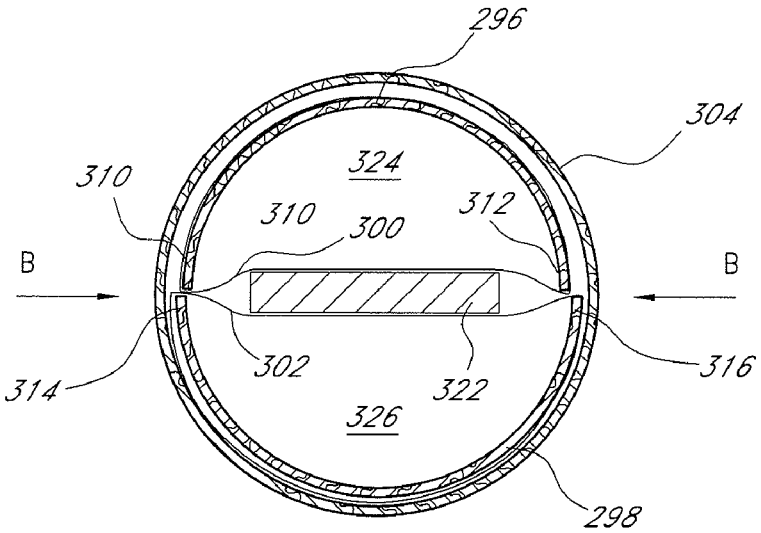
FIG. 29 is a sectional view taken along line 29-29 shown in FIG. 28.

With reference to FIGS. 27-29, a further aspect of the invention is illustrated therein. As shown in FIG. 27, a packaging assembly 294 includes at least a pair of semicircular members 296, 298, which are received within retention sleeves 300, 302, respectively. The assembly also includes a retaining device 303. In one embodiment, the retaining device 303 is in the form of a cylindrical member 304 and end caps 306, 308. Alternatively, the retaining device 303 can comprise any suitable device for maintaining the semicircular members 296, 298 in opposed relation, discussed below in more with reference to FIG. 29.

The semicircular members 296, 298 are preferably constructed of a high density cardboard paper product such as chip board or molded pulp. Similarly, the cylindrical member 304 desirably is also formed of a high density cardboard paper. The semicircular members 296, 298 and the cylindrical member 304, however, can be made from any substantially rigid material appropriate for packaging purposes. Preferably, the semicircular members 296, 298 are formed from a cylindrical member having the same radius of curvature as the cylindrical member 304, and having been cut into two approximately identically sized pieces.

As shown in FIG. 27, the semicircular members 296, 298 include free lateral edges 310, 312, 314, 316. Thus, when the semicircular members 296, 298 are inserted into the retention sleeves 300, 302, unsupported spans 318, 320 of the retention sleeves 300, 302, respectively, are arranged between the lateral free edges 310, 312, and the lateral edges 314, 316 of the semicircular members 296, 298, respectively.

With reference to FIGS. 28 and 29, the assembly 294 constructed as such can be used to package an article 322. As shown in FIG. 29, it is preferable that the lateral edges of one of the rigid semicircular members are arranged between the free lateral edges of the other rigid semicircular member. For example, as shown in FIG. 29, the free lateral edges 310, 312 are arranged between the free lateral edges 314, 316. Thus, with the rigid semicircular members 296, 298, arranged as such, the retention sleeves 300, 302 are tightened due to the nesting arrangement of the free lateral edges 310, 312 of the rigid semicircular member 296 between the free lateral edges 314, 316 of the rigid semicircular member 298.

As noted above, it is desirable to form the rigid semicircular members 296, 298 from a cylindrical member having the same diametric dimensions as the cylindrical member 304, having been cut into two approximately identically sized halves. Formed as such, the rigid semicircular members 296, 298, when nested as shown in FIG. 29, and arranged within the cylindrical member 304, provide sufficient tension in the respective resilient sleeves 300, 302 for suspending an article 322 therein. Alternatively, the semicircular members 296, 298 can be formed with a smaller radius in some applications where the article 322 placed between the semicircular members 296, 298 produces sufficient tension in the sleeves 300, 302.

As shown in FIG. 28, the caps 306, 308 can be fit onto open ends 324, 326 of the rigid cylindrical member 304 with the rigid semicircular members 296, 298 and their respective retention sleeves 300, 302 arranged therein. As such, the caps 306, 308 ensure that the article 322 and the semi-circular members 296, 298 remain within the cylindrical member 304.

By constructing the assembly 294 as such, the assembly achieves several advantages over the prior art. For example, since the retention sleeves 300, 302 are not permanently affixed to the rigid semicircular members 296, 298, the retention sleeves 300, 302 can be manufactured at a geographically distant location, as discussed above with respect to the retention sleeve 14 illustrated in FIGS. 2-5. Additionally, by utilizing a pair of rigid semicircular members 296, 298, the packaging assembly 294 can be used to package an oddly shaped article, such as a watch, without any additional padding material. As viewed in FIG. 29, the semicircular shape of the rigid semicircular members 296, 298 provide relatively deep pockets 324, 326 for accommodating nonuniformly-shaped articles to be packaged.

As noted above, an alternative form of the retaining device 303 can include any suitable device for maintaining the semicircular members 296, 298 in an opposed arrangement when an article 322 to be packaged is disposed therebetween, as illustrated in FIG. 29. For example, the retaining device 303 can comprise tape, a rubber band, or string. These alternatives are preferable when the assembly 294 is used for a mass packaging product. For example, a large number of articles 322 to be packaged can be supported between the semicircular members 296, 298 and secured with any of the above noted alternative forms of the retaining device 303. The assemblies 294 can then be placed in a large single compartment container such as for example but without limitation, a cardboard box.

Figure 31:
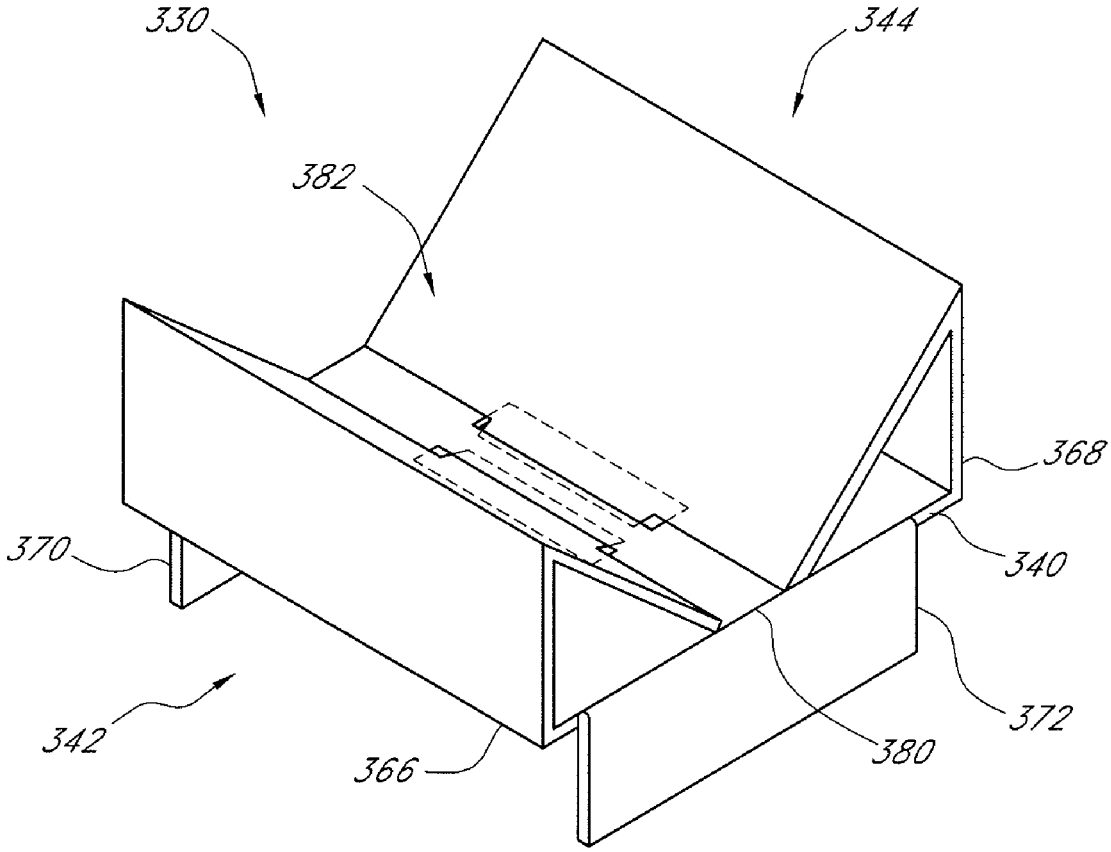
FIG. 31 is a top, right, and front perspective view of the frame member illustrated in FIG. 30 in a folded state.
Figure 32:
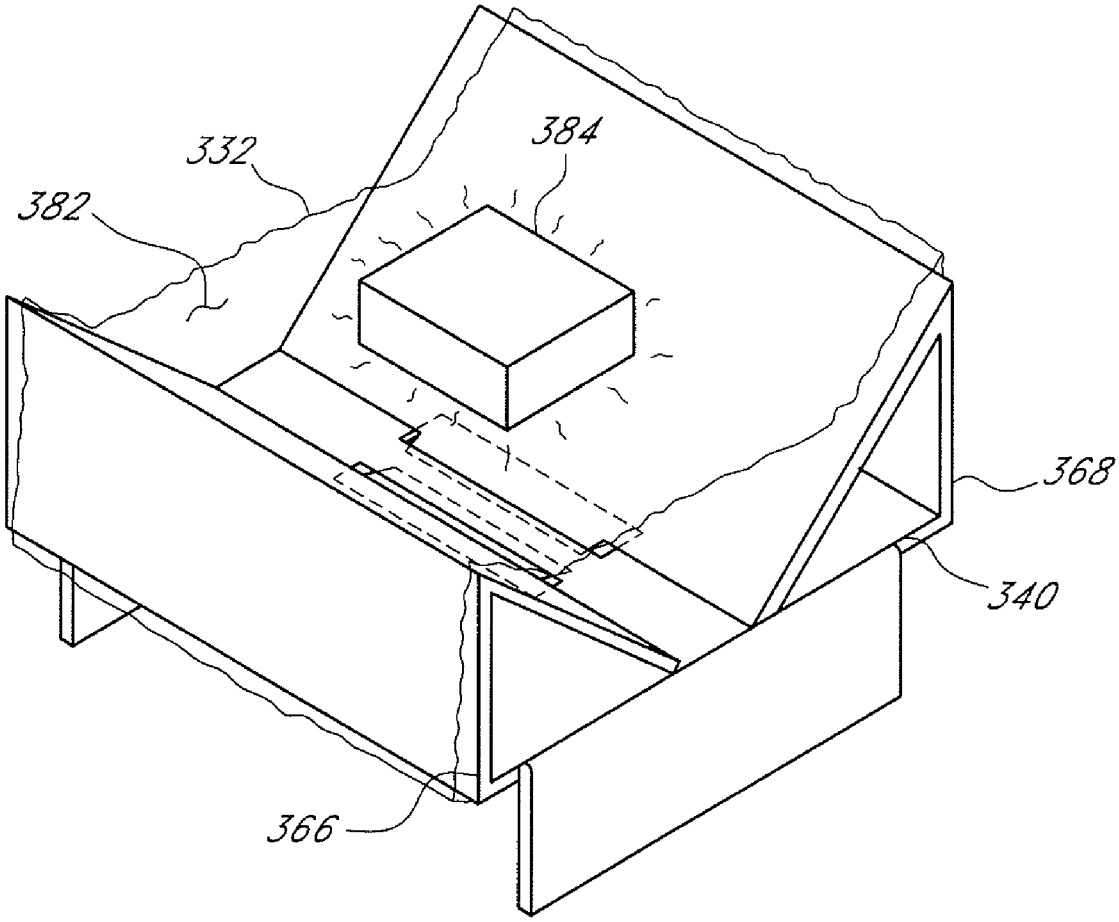
FIG. 32 is a top, right, and front perspective view of the frame member illustrated in FIG. 30, a first retention member extending around a part of the frame member, and an article to be packaged being supported by the retention member.
Figure 33:
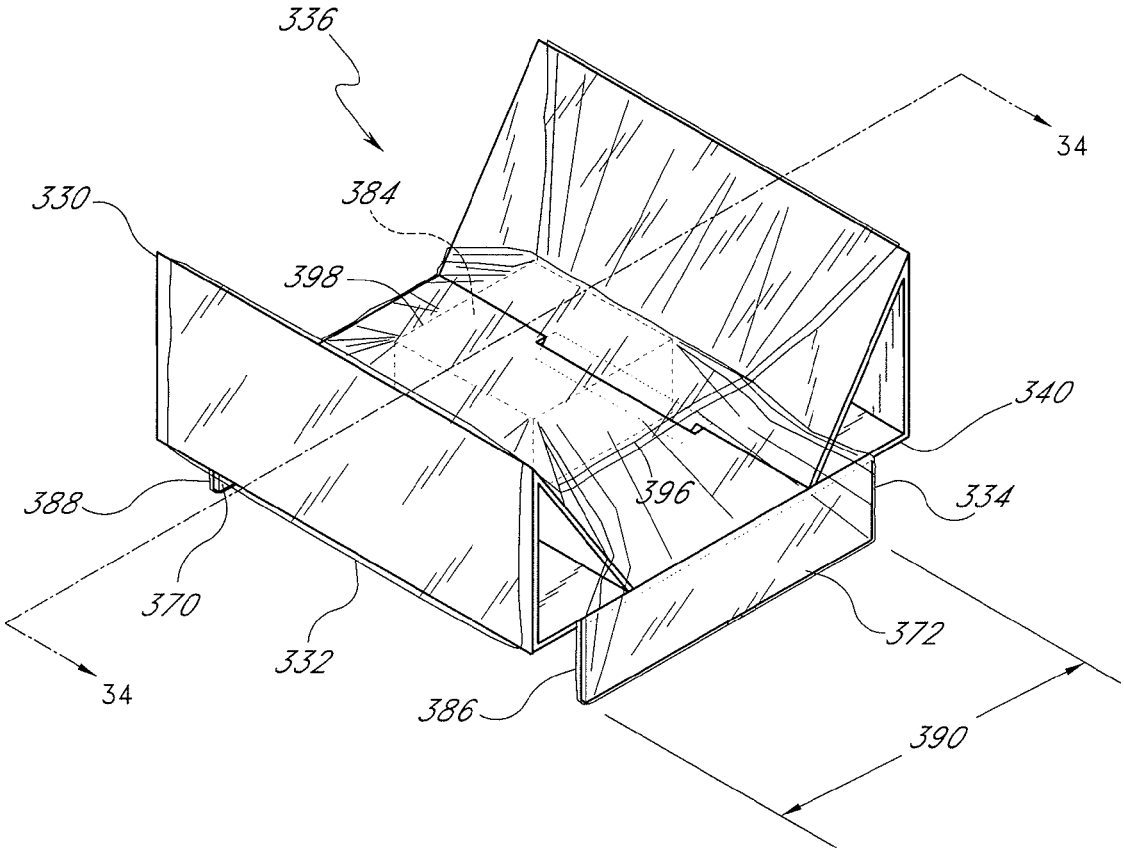
FIG. 33 is a top, right, and front perspective view of the embodiment illustrated in FIG. 32 having a second retention member drawn over the article to be packaged illustrated in FIG. 32.

With reference to FIGS. 30-34, a further modification of the embodiments of the packaging assemblies illustrated in FIGS. 1-26 is shown therein. The present modification is a combination of two of the aspects of the invention illustrated in FIGS. 1-26. The packaging assembly according to the present modification includes a frame member 330 (FIGS. 30 and 31), a first retention member 332 (FIG. 32) and a second retention member 334 (FIG. 33) which cooperate to form a packaging assembly 336 as shown in FIG. 33.

Figure 30:
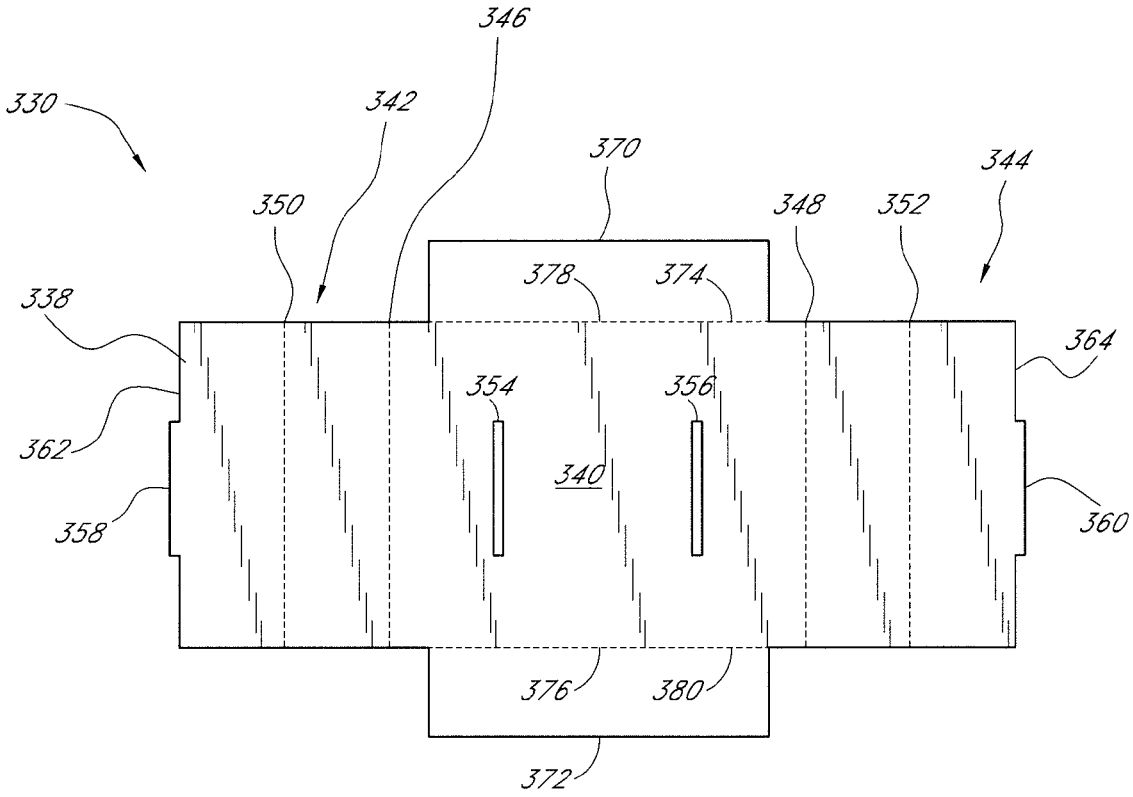
FIG. 30 is a top plan view of a frame member of a modification of the embodiment of FIGS. 1-4, in an unfolded state.

As shown in FIG. 30, the frame member 330 is formed of a rigid body member 338. In the illustrated embodiment, the rigid body 338 is generally rectangular. However, it will be apparent to one of ordinary skill the art that the rigid body 338 can be formed in various other shapes according to the desired overall characteristics of the packaging assembly 336. As shown in FIG. 30, the rigid body 338 includes a main substrate portion 340. First and second foldable portions 342, 344 are disposed at opposite ends of the main substrate portion 340.

In the illustrated embodiment, the foldable portions 342, 344 are connected to the main substrate portion 340 along fold lines 346, 348. Additionally, the foldable portions 342, 344 are configured to form releasably engageable peripherally extending structures. In the illustrated embodiment, the foldable portions 342, 344 include fold lines 350, 352, respectively, approximately bisecting the foldable portions 342, 344. Additionally, the main substrate portion 340 includes receptacles 354, 356. Projections 358, 360 are disposed on the free ends 362, 364 of the foldable portions 342, 344, respectively. As such, the foldable portions 342, 344 can be folded into peripherally extending structures 366, 368 similar to the peripherally extending structures 58, 60 illustrated in FIG. 3. Additionally, the frame member 338 includes rotatable portions 370, 372 disposed on opposite lateral edges 374, 376 of the main substrate portion 340. The rotatable portions 370, 372 are connected to the main substrate portion 340 along fold lines 378, 380.

The construction of the rigid body 330, including the main substrate portion 340 and the foldable portions 342, 344 can be constructed in accordance of the description of the frame member 14 illustrated in FIGS. 1-4 and 8. The rotatable portions 370, 372 can be constructed in accordance with the description of the rotatable portions 190, 192 illustrated in FIGS. 17 and 19-22. Thus, a further description of the construction of the frame member 330 is not necessary for one of ordinary skill in the art to practice the invention as disclosed herein.

With reference to FIG. 31, the frame member 330 is illustrated in a folded state in which the foldable portions for 342, 344 are deployed into releasably engageable peripherally extending structures 366, 368. Similarly to the foldable portions 26, 28 illustrated in FIG. 1, the foldable portions 342, 344 are folded into the peripherally extending structures 366, 368 by engaging the projections 358, 360 with the receptacles 354, 356, respectively. As illustrated in FIG. 31, the peripherally extending structures 366, 368 are spaced from each other so as to form a recess 382 therebetween. Additionally, FIG. 33 also illustrates the rotatable portions 370, 372 rotated approximately 90 degrees downward, as viewed in FIG. 31.

With reference to FIG. 32, the first retention member 332 is in the form of a sleeve. The first retention member 332 can be constructed in accordance with the description of the retention sleeve 14 described above with reference to FIGS. 2-4. Thus a further description of the retention member 332 is not necessary for one of ordinary skill in the art to practice the invention disclosed herein.

In FIG. 32, the retention member 332 is illustrated as being wrapped around the first and second peripherally extending structures 366, 368 and the main substrate portion 340. An unsupported span 382 of the retention member 332 extends between the structures 366, 368. Preferably, as illustrated in FIG. 32, the retention member 332 is sized so as to loosely fit around the frame member 330 when the peripherally extending structures 366, 368 are deployed. The fit of the retention member over the frame member will depend on the desired characteristics of the resulting packaging device. Additionally, an article 384 to be packaged is illustrated as being supported on the unsupported span 382.

With reference to FIG. 33, the second retention member 334 is illustrated as extending over the article to be packaged 384. The retention member 334 includes pockets 386, 388 at opposite ends thereof. In the illustrated embodiment, the second retention member 334 can be constructed in accordance with the description of the retention member 182 illustrated in FIG. 18. Thus, a further description of the construction of the second retention member 334 is not necessary for one of ordinary skill in the art to make and use this mode of the packaging assembly as disclosed herein.

As shown in FIG. 33, the rotatable portions 372, 370 are received within the pockets 386, 388, respectively, of the second retention member 334. As noted above, the first retention member 332 preferably is sized so as to be slightly slackened when fit over the frame member 330. Additionally, the first and second retention member 332, 334 are sized such that when the second retention member 334 is engaged with rotatable portions 370, 372 and the rotatable portions 370, 372 are rotated downwardly (as viewed in FIG. 33), the first and second retention members 332, 334 are sufficiently tightened so as to restrain the article 384 to the extent desired. As such, the first and second retention members 332, 334 substantially envelope the article 384 and thereby restrain movement of the article 384 relative to the frame member 330 in virtually all directions.

The widths of the first and second retention members 332, 334 can also be varied to achieve or enhance certain characteristics of the assembly 336. For example, by sizing the width 390 of the retention member 334 so as to be substantially larger than a width of the article 384, the retention member 334 gathers along its lateral edges 392, 394, as illustrated in FIG. 33. Similarly, a width of the first retention member 332 can be sized to form gathers along lateral edges 396, 398. The gathers formed along the lateral edges 392, 394, 396, 398 further aid in preventing the article 384 from moving relative to the frame member 330 when packaged.

Figure 34:
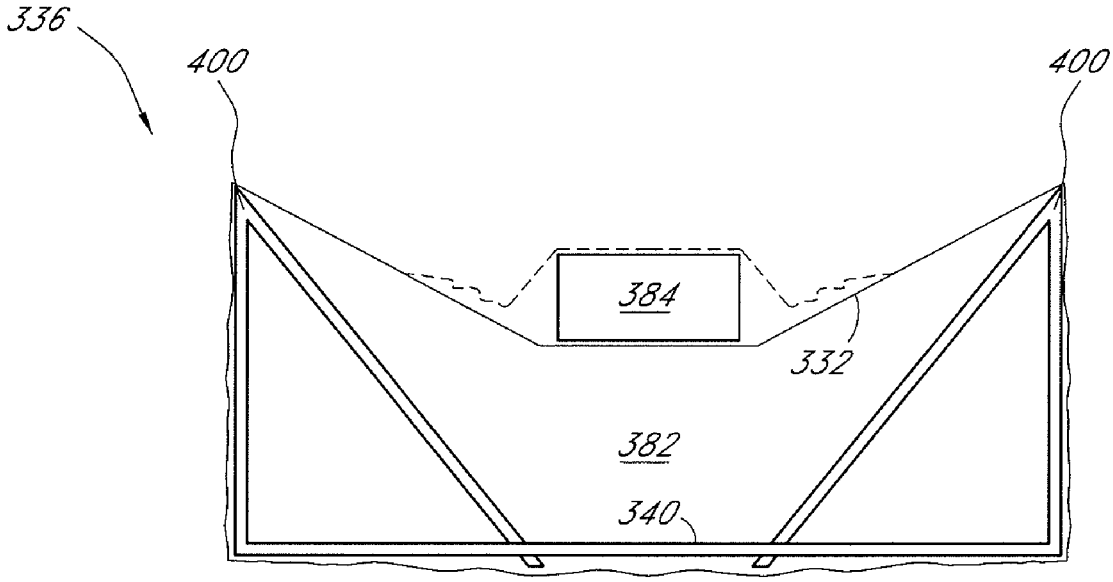
FIG. 34 is a cross-sectional view of the embodiment illustrated in FIG. 33 taken alone line 34-34.

Several advantages are achieved by constructing the assembly 336 as such. For example, as illustrated in FIG. 34, the article 384 can be suspended in the recess 382 wholly by the retention members 332, 334. The retention members 332, 334 can be appropriately sized such that the article 384 is suspended completely within the recess 382, above the main substrate portion 340 and below the upper peripheral edge 400 of the assembly 336. Thus, the retention members 332, 334 substantially surround the article 384 and restrain the article 384 from moving laterally between the retention members 332, 334. Thus, the article 384 remains suspended within the recess 382.

Additionally, by constructing the frame member 330 with rotatable portions 370, 372, an additional cushioning effect can be achieved with the rotatable portions 370, 372. For example, as noted above with respect to the rotatable portions 192, 194 illustrated FIGS. 21-22B, each rotatable portions 370, 372 can be rotated or folded to a position beneath the main substrate portion 340 so as to form a cantilever-type spring due to the resiliency or "fiberous memory" of the frame member 330 and/or the resiliency of the retention member 334.

Figure 35:
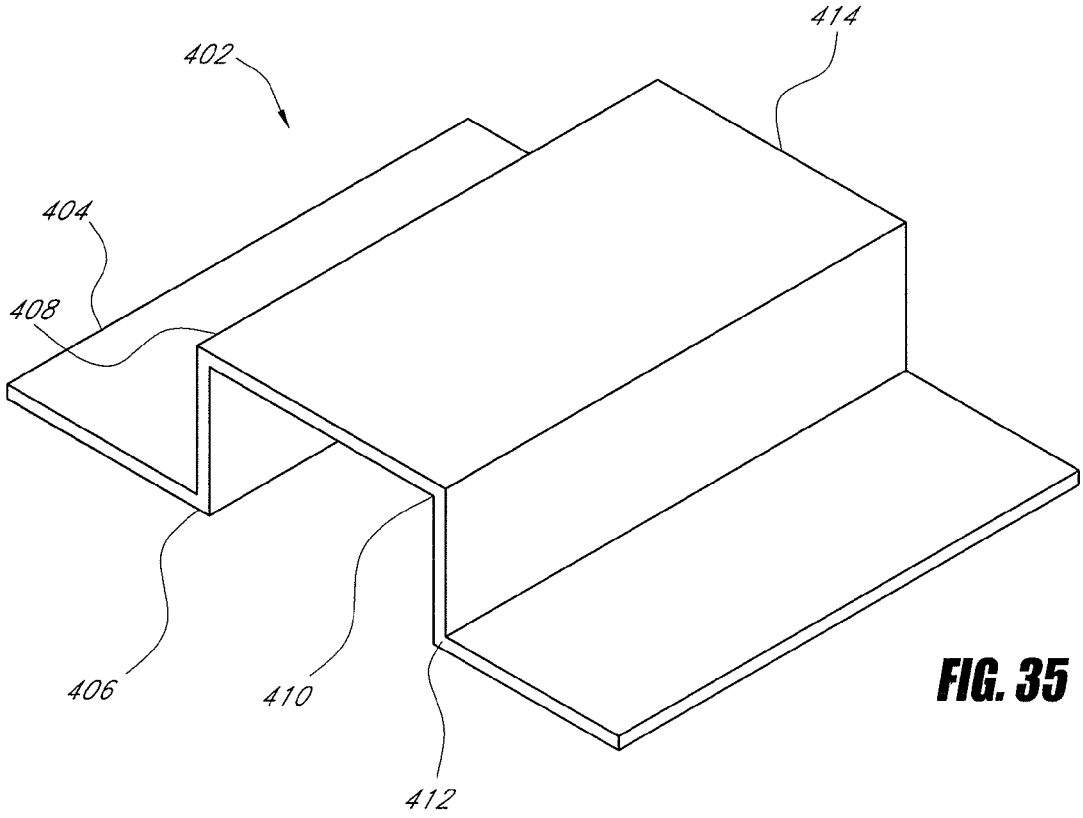
FIG. 35 is a top front and left side perspective view of a modification of the support member illustrated in FIG. 12.
Figure 36:
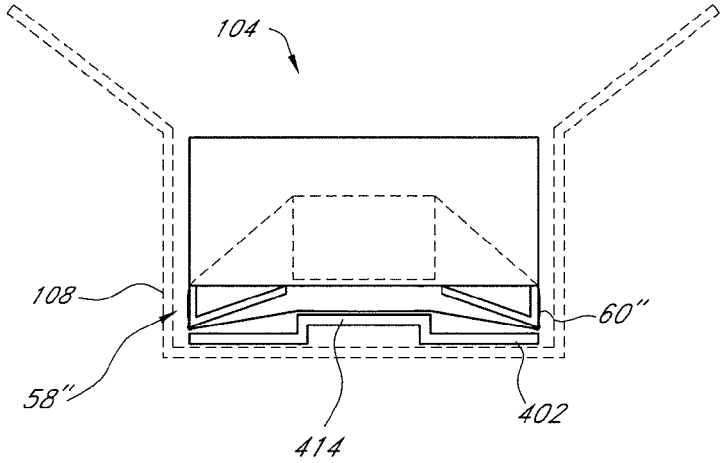
FIG. 36 is a front elevational view of the packaging assembly illustrated in FIG. 12 inserted in the box (shown in phantom) and supported by the assembled modified support member illustrated in FIG. 35.

With respect to FIGS. 35-40, further embodiments of the box 108 and the support member 110 are illustrated therein. FIGS. 35 and 36 illustrate the modification of the support member 110 shown in FIG. 12. As shown in FIG. 35, a support assembly 402 is formed a rigid body 404, such as a cardboard panel, folded along folds lines 406, 408, 410, 412 so as to form a longitudinally extending support member 414. In the illustrated embodiment, the support member 402 can be formed generally in accordance with the description of the frame member 12 illustrated in FIG. 1.

As shown in FIG. 36, the support assembly 402 can be inserted into the box 108 such that the support member 414 extends between and generally parallel to the peripherally extending structures 58", 60". As such, the support member 414 provides a uniform cushioning effect over the length of the packaging assembly 104.

Figure 37:
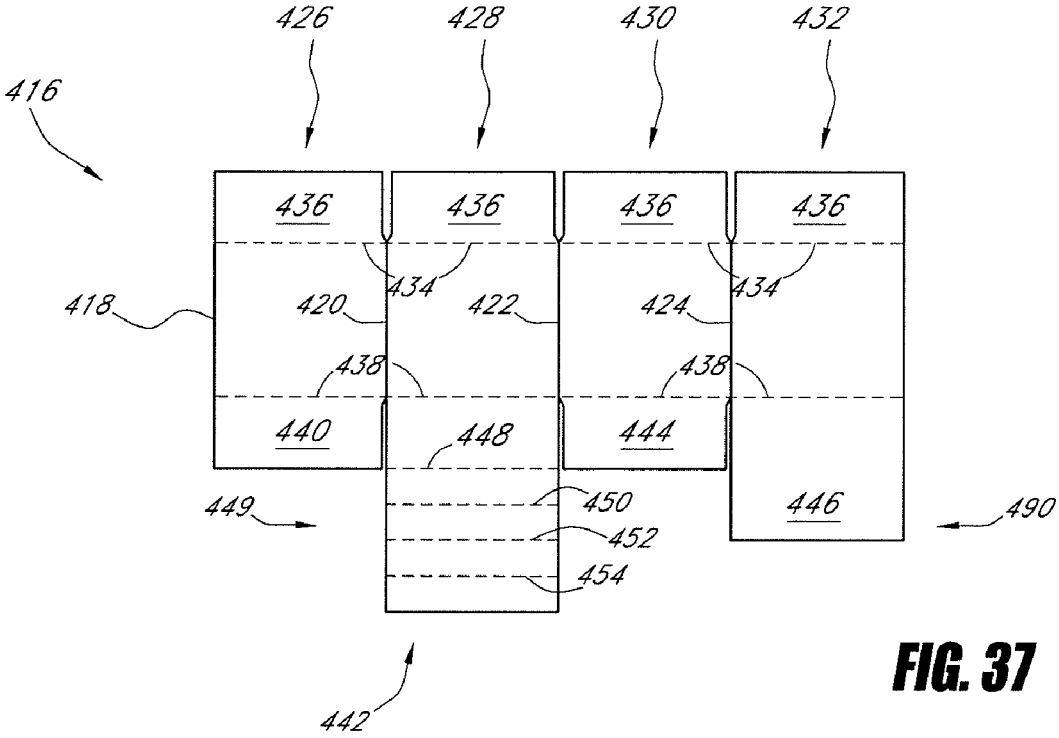
FIG. 37 is a top plan view of the modification of the box illustrated in FIG. 12, in an unfolded state.
Figure 38:
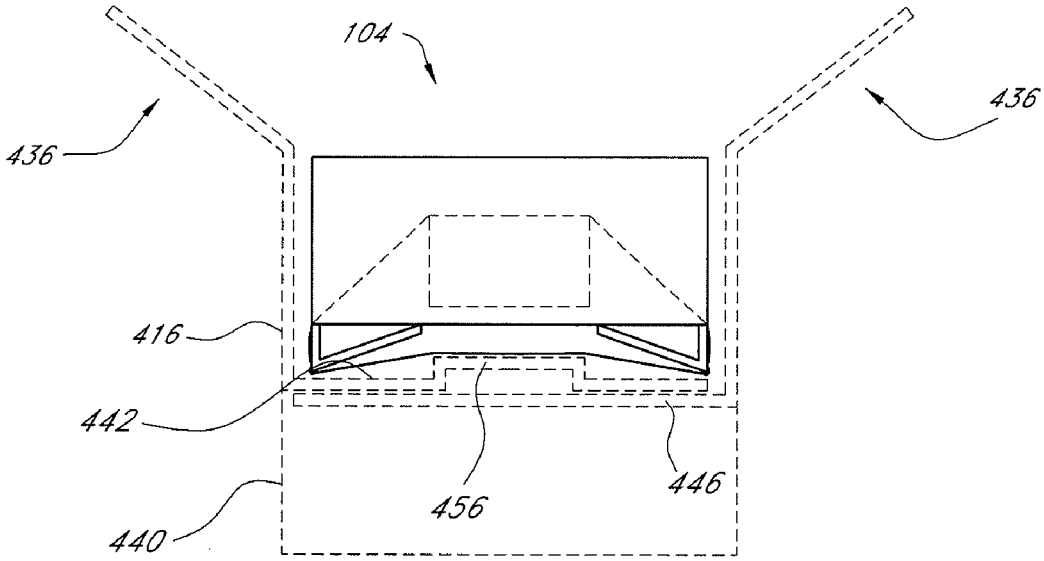
FIG. 38 is a front elevational view of the packaging assembly illustrated in FIG. 12 inserted within the assembled modified box illustrated in FIG. 37 (shown in phantom)

As noted above with reference to the support member 110 illustrated in FIG. 12, the support member 110 can be constructed from flaps forming the bottom surface 114 of the box 108. FIGS. 37 and 38 illustrate a box 416 that embodies such a modification of the box 108.

With reference to FIG. 37, the box 416 is formed similarly to a conventional cardboard box. In the illustrated embodiment, the box 416 is constructed from a body 418 having fold lines 420, 422, 424 defining four panels 426, 428, 430, 432. As is typical in cardboard box design, each panel 426, 428, 430, 432 includes upper fold lines 434 defining upper flaps 436, respectively. Additionally, each panel 426, 428, 430, 432 includes lower fold lines 438 defining lower flaps 440, 442, 444, 446.

As shown in FIG. 37, the lower flap 442 of the panel 428 includes a foldable portion 449 comprising additional fold lines 448, 450, 452, 454 disposed on the lower flap 442. As such, the lower flap 442 can be folded along the fold lines 448, 450, 452, 454 so as to form a support member 456, as shown in FIG. 38. Thus, in this embodiment, a support member similar to the support member 402 illustrated in FIG. 35 can be integrally (i.e., unitarily) formed with the box 416.

Figure 39:
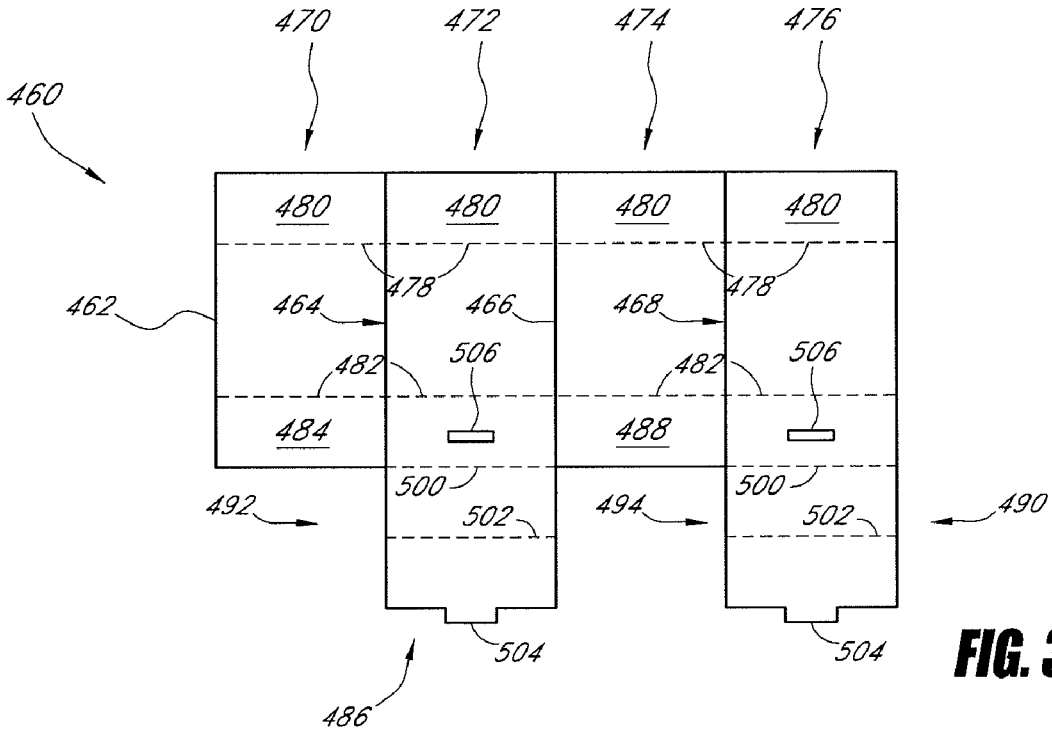
FIG. 39 is a top plan view of a modification of the box illustrated in FIG. 12 in an unfolded state.
Figure 40:
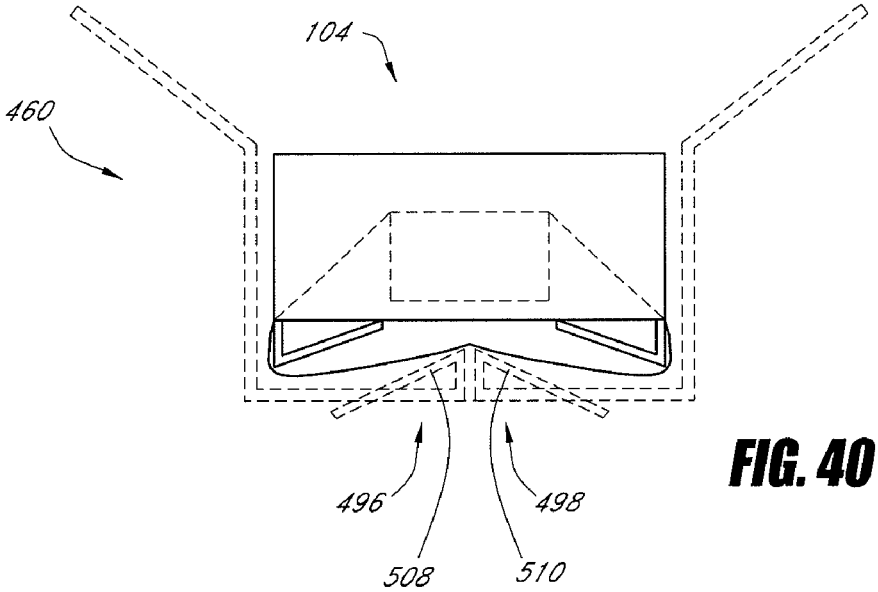
FIG. 40 is a front elevational view of the packaging assembly illustrated FIG. 12 inserted within the assembled modified box of FIG. 39 (shown in phantom).

With reference to FIGS. 39 and 40, a further modification of the box 416 is illustrated therein. As shown in FIG. 39, a box 460 is formed of a body member for 62 having a plurality of fold lines 464, 466, 468 dividing the body member 462 into four panels 470, 472, 474, 476. At an upper end thereof, the panels 470, 472, 474, 476 include fold lines 478 defining upper flaps 480 similar to the upper flaps 436 of the box 416 illustrated in FIG. 37.

Additionally, the body 462 includes lower fold lines 482 defining lower flaps 484, 486, 488, 490. Preferably, at least one of the lower flaps 484, 486, 488, 490 includes a foldable portion configured to form a support member. In the illustrated embodiment, the lower flaps 486, 490 include foldable portions 492, 494, respectively. The foldable portions 492, 494 include first and second fold lines 500, 502 disposed between a projection 504 and a receptacle 506. As such, the foldable portions 492, 494 are configured to form releasably engageable peripherally extending structures 508, 510.

In the illustrated embodiment, the releasably engageable peripherally extending structures for 508, 510 are in the form of triangular cylinders. However, as noted above with reference to the peripherally extending structure 58, 60 illustrated in FIGS. 3, 4, and 6-8, the foldable portions 492, 494 can be configured to form peripherally extending structures having any shape. It is to be noted that the foldable portions 492, 494 can be provided on any of the upper or lower flaps 480, 484, 486, 488, 490, depending on the desired orientation of the assembly 104 within the box 460.

By including a foldable portion 449, 492, 494 on at least one of the upper or lower flaps 436, 440, 442, 444, 446, 480, 484, 486, 488, 490 of a box 416, 460 where the foldable portion 449, 492, 494 is configured to form a support member for a packaging assembly such as the packaging assembly 104, the present embodiment further simplifies the use and particularly the assembly of a box for the assembly 104.

Of course, the foregoing description is that of certain features, aspects and advantages of the present invention to which various changes and modifications can be made without departing from the spirit and scope of the present invention. Moreover, the packaging assembly may not feature all objects and advantages discussed above to use certain features, aspects, and advantages of the present invention. Thus, for example, those skilled in the art will recognize that the invention can be embodied or carried out in a manner that achieves or optimizes one advantage or group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of the specific features and aspects of the embodiments may be made and still fall within the scope of the invention. For example, an upper packaging assembly, similar to that illustrated in FIG. 6, can be used with a lower packaging assembly, similar to that illustrated in FIG. 11, especially where the height of the lower packaging assembly is less than an inner height within a box that contains the packaging assemblies. Accordingly, it should be understood that various features and aspects of the disclosed embodiments can be combined with or substituted for one another in order to form varying modes of the disclosed packaging assemblies. The present invention, therefore, should only be defined by the appended claims.

What is claimed is:

1. A suspension packaging assembly comprising:

at least a first retention member comprising a body portion which comprises a first end and a second end opposite the first end, the first retention member further comprising first and second pockets formed at the first and second ends, respectively; and a first frame member having a central portion, and first and second leg portions connected to the central portion, the first and second leg portions being configured to be received within the first and second pockets, respectively, so as to provide engagement between the first retention member and the first frame member.

2. The assembly according to claim 1, wherein the first and second leg portions are rotatable relative to the central portion.

3. The assembly according to claim 1, wherein the first retention member is substantially resilient, the first frame member being substantially rigid.

4. The assembly according to claim 1, wherein the first retention member is made of a single piece of a resilient sheet.

5. The assembly according to claim 4, wherein the first retention member comprises a folded portion with two closed, opposite side portions to form the first pocket.

6. The assembly according to claim 1, wherein the first frame member is made of a single piece of cardboard.

7. The assembly according to claim 1, wherein the first frame member is formed of a substrate having at least a first and a second fold line, the first fold line extending between the first leg portion and the central portion of the frame member and the second fold line extending between the central portion and the second leg portion.

8. The assembly according to claim 1, wherein the first and second leg portions are rotatable between a first position in which the first retention member is slackened when the first and second leg portions are received in the first and second pockets, and a second position in which the first retention member is elastically distorted when the first and second leg portions are received in the first and second pockets.

9. The assembly according to claim 1, wherein at least one of the first leg portion, the second leg portion, and the first retention member is sized such that the retention member is stretched over an article to be packaged when the article is placed between the first frame member and the first retention member and the first and second members are rotated towards a position which tightens the first retention member.

10. The assembly according to claim 1 additionally comprising:

a second retention member having third and fourth pockets formed on opposite ends thereof, a second frame member having third and fourth leg portions configured to be received by the third and fourth pockets, respectively, wherein the first frame member includes a first aperture defined between the first and second leg portions, and the second frame member includes a second aperture formed between the third and fourth leg portions, and wherein the first and second frame members are rotatably connected to each other.

11. The assembly according to claim 1 additionally comprising a container having an inner wall, the first frame member including a first surface and a second surface, and wherein at least one of the first leg portion, the second leg portion, and the first retention member being configured such that when an article to be packaged is positioned between the first surface of the frame member and the first retention member and the first and second leg portions are folded so as to tighten the first retention member, the first and second leg portions form a spring between the first frame member and the inner wall of the container.

* * * * *